United States Patent [19]

Malkemes et al.

[11] Patent Number: 4,844,635

[45] Date of Patent: Jul. 4, 1989

[54] WIRE FIRE CONTROL MECHANISM FOR A WIRE MATRIX PRINTER

[75] Inventors: Charles D. Malkemes, Matthews; Barry R. Cavill, Charlotte, both of N.C.

[73] Assignee: International Business Machines Corp., Armonk, N.Y.

[21] Appl. No.: 140,893

[22] Filed: Dec. 30, 1987

Related U.S. Application Data

[63] Continuation of Ser. No. 807,709, Dec. 11, 1985, abandoned.

[51] Int. Cl.[4] ..... B41J 3/12

[52] U.S. Cl. ..... 400/124; 400/279; 400/322; 101/93.05

[58] Field of Search ..... 400/121, 124, 279, 320, 400/322, 328; 101/93.04, 93.05; 364/518, 519

[56] References Cited

U.S. PATENT DOCUMENTS

| | | | |
|---|---|---|---|
| 4,116,567 | 9/1978 | San Pietro | 400/124 |
| 4,119,383 | 10/1978 | Watanabe | 400/124 |
| 4,125,336 | 11/1978 | Chu | 101/93.05 X |
| 4,159,882 | 7/1979 | Sanders | 400/124 |
| 4,180,334 | 12/1979 | Watanabe | 400/124 |
| 4,284,362 | 8/1981 | Jackson | 400/124 |
| 4,326,813 | 4/1982 | Lomicka | 400/124 |
| 4,459,050 | 7/1984 | Goldberg | 400/124 |
| 4,468,140 | 8/1984 | Harris | 400/124 |
| 4,508,463 | 4/1985 | Wang | 400/124 |

FOREIGN PATENT DOCUMENTS

| | | | |
|---|---|---|---|
| 627 | 9/1979 | World Int. Prop. O. | 400/124 |

*Primary Examiner*—Paul T. Sewell
*Attorney, Agent, or Firm*—William N. Hogg

[57] ABSTRACT

A wire fire control mechanism is provided for use in a wire matrix printer for controlling the firing of the print wires as the printhead moves across a print receiving medium. This wire fire control mechanism enables printing to be accomplished for a wide range of different printhead speeds. It also enables printing to be accomplished while the printhead is accelerating or decelerating. It further enables dots to be printed at positions which are not dependent on or limited to the fixed points defined by the emitter signals which are used to keep track of the position of the printhead as it moves across the print receiving medium. In a representative embodiment, the wire fire control mechanism includes emitter means for sensing movement of the printhead and producing emitter signals which define fixed points across the print receiving medium. The control mechanism also includes means for providing a target signal for determining a position at which a dot may be printed on the print receiving medium, such dot position not being dependent upon or limited to the fixed points defined by the emitter signals. The control mechanism further includes means for sensing the speed of the printhead and producing a flight time distance signal representing the distance the printhead will move while a print wire is in flight from the printhead to the print receiving medium. The control mechanism further includes means responsive to the target signal, the emitter signals and the flight time distance signal for producing a wire fire signal when the distance between the print wire position and the target becomes substantially equal to the flight time distance.

10 Claims, 12 Drawing Sheets

WIRE FIRE CONTROL MECHANISM FOR A WIRE MATRIX PRINTER

This application is a continuation of co-pending application Ser. No. 807,709, filed on Dec. 11, 1985, now abandoned.

TECHNICAL FIELD

This invention relates to methods and apparatus for controlling the firing of print wires in the moving printhead of a wire matrix printer.

BACKGROUND ART

Wire matrix printers employ a set of print wires which are located in a printhead which is mounted on a carriage which moves the printhead back and forth across a platen on which rests the paper on which the characters and images are to be printed. An individual actuator coil is provided for each print wire. Energizing of an actuator coil by an electrical pulse fires the associated print wire. In particular, this causes the print wire to move forward rapidly and drive the printing ribbon against the paper to print a dot on the paper. The printing ribbon is located between the printing end of the printhead and the paper. Each of the various alphabetical, numerical and other printed characters is formed by printing a pattern of dots which create the shape of the character on the paper.

In order to form the printed characters on the paper, it is necessary to correlate the firings of the print wires with the location or position of the printhead along its path of travel as it moves across the paper. This is accomplished by providing a mechanism which generates a series of position marker pulses as the printhead moves across the paper A position marker pulse is generated each time the printhead moves a fixed incremental distance. The position of the printhead can be continuously monitored by counting these marker pulses.

These position marker pulses are sometimes referred to as "emitter" pulses or "emitter" signals and the mechanism which produces them is sometimes referred to as an "emitter" mechanism. This "emitter" terminology will be used in the present specification and claims. Also, the term "emitter" will be used as a unit of distance measurement. In this case, one emitter unit represents the distance the printhead will move between the generation of the leading edge of one emitter signal and the generation of the leading edge of the next emitter signal. It represents the physical distance corresponding to the spacing between the beginnings of two successive emitter signals. The value of an emitter unit is a fixed constant for any given printer and is usually relatively small, typically on the order of a few thousandths of an inch.

There are two primary types of emitter mechanisms, namely, a linear emitter mechanism and a rotary emitter mechanism. The linear emitter mechanism includes a stationary linear element which is attached to the printer frame and which extends the length of the platen. The linear element has uniformly spaced indicia on it which are sensed by a detector element which is carried on the printhead carriage. A rotary emitter mechanism, on the other hand, includes a rotary encoder type device having a movable element which is coupled to the drive system for the printhead carriage so that it will rotate as the printhead moves across the platen. Rotation of the movable element generates emitter signals. In either case, linear or rotary, a new emitter signal is produced each time the printhead moves a fixed incremental distance across the paper.

Various forms of wire fire control systems have been heretofore used to indicate when the print wires should be fired. The most common technique for generating the wire fire timing is to simply fire the appropriate print wires whenever an emitter pulse occurs. In the case of bidirectional printing, a time delay is added following the occurrence of the emitter pulses when moving in one of the directions to enable dots produced with the printhead moving in opposite directions to align vertically with one another. A more sophisticated technique that has been proposed is to use timing circuitry to generate pseudo-emitter pulses (usually two or three between the leading edges of the actual emitter pulses. This provides more times at which print wires may be fired and thereby provides somewhat better resolution. A problem with these known and proposed methods is that the character fonts or character styles which can be printed must be compatible with the emitter pulse spacing. This limits the choices for various font parameters such as dot density, characters per inch, and the like.

Another factor that needs to be taken into account in a wire matrix printer is the flight time of the print wire. A finite time, on the order of a few hundred microseconds, is required to get the print wire moving and to move it the necessary distance to strike the ribbon against the paper. This causes a problem because the printhead is also moving across the paper while the print wire is in flight. Thus, by the time the print wire strikes the paper, the print wire is no longer in the same position across the paper as it was when the firing of the print wire was commenced. The printhead may have moved anywhere from two or three or more emitter positions while the print wire was in flight. If not taken into account properly, this flight time factor can cause the different printed dots to be unevenly spaced relative to what is desired.

A common method of handling the print wire flight time is to print only when the printhead is moving at a known constant speed. In this case, the effect of the print wire flight time is the same for all of the printed dots. Consequently, there is no distortion or unevenness in the printed text or image. Also, for the case of bidirectional printing where some characters are printed with the printhead moving from left to right and other characters are printed with the printhead moving from right to left, proper alignment for the two directions can be maintained by adding a fixed time delay when printing in one of the two directions.

It is desirable to be able to print at a variety of different constant speeds. For one thing, this enables different character fonts to each be printed at its own maximum printhead speed, such maximum speed being a function of the dot density. It is also desirable to be able to print at non-constant printhead speeds. In other words, it is desirable to be able to print while the printhead is accelerating or decelerating. For one thing, this enables a reduction of the overall width of the printing apparatus because the side areas of the printer need not be wide enough to enable the printhead to get up to a constant speed before entering the printing region. For another thing, it enables changing printhead speeds and hence character fonts in the middle of a line of printing.

Accurate dot placement cannot be obtained at different speeds or when the printhead is accelerating or decelerating, unless a mechanism is provided for compensating for the print wire flight time and for changing the amount of compensation as a function of printhead speed. This is because the distance the printhead moves while the print wire is in flight is a function of the speed of the printhead. This distance will be different for different printhead speeds. As far as is known, no generally acceptable mechanism has been heretofore proposed for providing accurate dot placement for a relatively wide range of printhead speeds.

Accurate dot placement is of critical importance when doing color printing or when printing graphic images. For color printing, intermediate colors are obtained by overprinting the same dot positions with different colors on different passes of the printhead. When printing graphic images, different portions of an overall image may appear on different print lines, thus requiring good vertical alignment from print line to print line.

SUMMARY OF INVENTION

This invention provides new and improved wire fire control methods and mechanisms for firing the print wires in a moving printhead in a wire matrix printer. In accordance therewith, a wire fire control mechanism for a print wire includes means for tracking the print wire position as the printhead moves across a print receiving medium. This tracking or position determining means may include, for example, emitter means associated with the printhead for producing emitter signals which define fixed points spaced across the print receiving medium. The wire fire control mechanism also includes means for establishing a target position at which a dot is to be printed on the print receiving medium. Such dot position is not dependent on or limited to the fixed points defined by the emitter signals. The wire fire control mechanism further includes means for determining the flight time distance, namely, the distance the printhead will move during the time interval between the time the wire is fired and the time the print wire will strike the print receiving medium. Such flight time distance determining means may include, for example, means for monitoring the printhead speed and adjusting the flight time distance as a function of such printhead speed. The wire fire control mechanism additionally includes means for firing the print wire when the distance between the print wire position and the target position becomes substantially equal to the flight time distance. This print wire firing means may include, for example, compensating means for subtracting the flight time distance from the target position for producing a firing distance signal representing the printhead movement needed to reach a wire fire position and means including counter means responsive to the firing distance signal and the emitter signals for providing information for producing the wire fire signal when the printhead is moved a distance represented by the firing distance signal.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DESCRIPTION OF THE PREFERRED EMBODIMENTS

Figure 1:
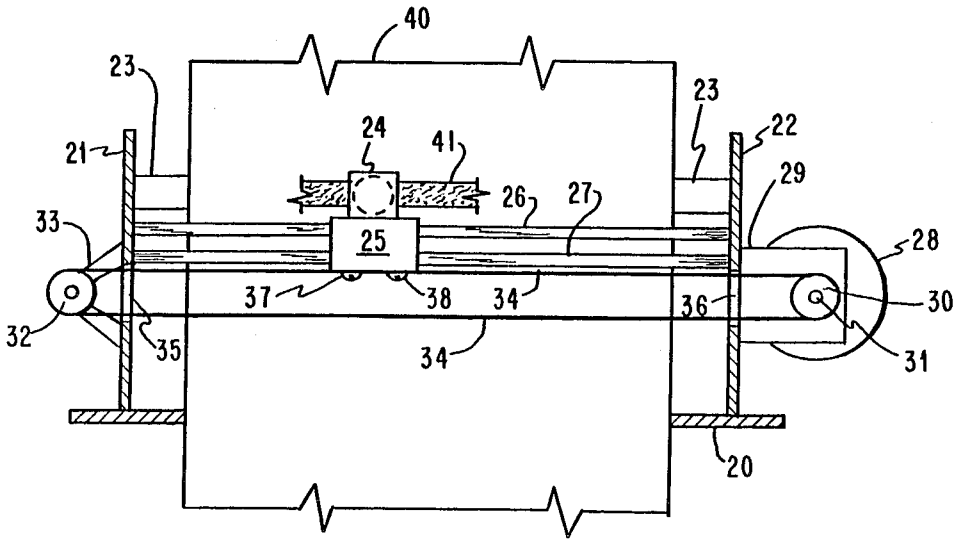
FIG. 1 shows in a simplified manner the major components of a wire matrix printer in which the present invention may be used to considerable advantage.

Referring to FIG. 1, there is shown in a simplified manner a wire matrix printer with its outer cover removed. This printer includes a base plate 20 and a pair of side frames 21 and 22 secured thereto. An elongated platen bar or platen 23 extends between the side frames 21 and 22 and the extremities of the platen 23 are secured to their respective side frames 21 and 22. A printhead 24 is mounted on a printhead carriage 25 which, in turn, is slidably mounted on a pair of carriage support shafts 26 and 27. The support shafts 26 and 27 run parallel to the platen 23 and the extremities of the support shafts 26 and 27 are secured to the side frames 21 and 22. The printhead carriage 25 is moved back and forth along the support shafts 26 and 27 by a motor pulley and belt mechanism. In particular, a reversible electric motor 28 is mounted on a bracket plate 29 which is, in turn, secured to the exterior of the side frame 22. A first pulley 30 is mounted on the shaft 31 of the motor 28. A second pulley 32 is mounted on the exterior side of the other side frame 21 by means of a bracket 33. A closed loop belt 34 is strung between and mounted on the two pulleys 30 and 32. Belt 34 passes through windows 35 and 36 cut through the side frames 21 and 22, respectively. Belt 34 is pinned to the underside of the printhead carriage 25 by means of screws 37 and 38.

It should be carefully noted that the printhead drive motor 28 is not a stepper motor. It is an ordinary direct-current motor and its rotor and shaft are caused to rotate whenever direct current is fed through its motor windings. The direction of rotation (clockwise or counterclockwise) is determined by the direction of the current flow through the motor windings. The speed of rotation is determined by the average value of the current flow through the motor windings.

In use, a print receiving medium 40 is positioned over the platen 23 on the side facing the printhead 24. This print receiving medium 40 is the medium on which the characters and images are to be printed. For sake of example, it will be assumed to be paper material of a desired length. Other examples of a print receiving medium include multi-part forms, envelopes, foils for visual projectors and the like. An inked printing ribbon 41, only a short segment of which is shown in FIG. 1, is located intermediate the printhead 24 and the print receiving paper 40. Ribbon 41 is supplied from a ribbon cartridge (not shown) and means (not shown) are provided for moving it past the printhead 24 to enable use of all the ribbon in the cartridge.

Energizing the printhead motor 28 with electric current produces movement of the belt 34 which, in turn, moves the printhead carriage 25 along the carriage support shafts 26 and 27. When the carriage 25 reaches one side of the printer, the direction of current flow is reversed and the carriage 25 moves back along the support shafts 26 and 27 in the opposite direction. In this manner, the carriage 25, and hence the printhead 24, is caused to move back and forth across the printer. The printing end of printhead 24 is in alignment with the platen 23 and moves back and forth across the length of the platen 23. There is a small spacing gap between the printing end of the printhead and the platen, this gap being sufficient to accommodate the ribbon and the paper with a little room to spare.

As the printhead 24 moves across the platen 23 and, hence, across the print receiving paper 40 resting on the platen 23, the individual print wires in the printhead 24 are fired to produce patterns of dots on the paper 40. More precisely, when a print wire is fired, it lunges forward toward the platen 23 and the end of the print wire drives the inked ribbon 41 against the paper 40 with a quick striking action to produce a dot of ink on the paper 40. After hitting the ribbon and paper, the print wire bounces back toward its at rest position in the printhead. A return spring associated with the print wire completes its return to its at rest position. By firing the different print wires at the proper times as the printhead 24 moves across the paper 40, the desired alphabetical characters, numerical characters and other characters (e.g., punctuation, dollar sign, etc.) are produced on the paper 40.

After one line of characters has been printed on the paper 40, the paper 40 is advanced by a paper feed mechanism (not shown) to bring a fresh line of paper into position on the platen 23. The next line of characters is then printed on this fresh line of paper. The paper 40 is stationary while a line of characters is being printed and is moved or advanced the appropriate distance after the completion of one line of printing and before the commencement of the next line of printing.

In a bidirectional printer, one line of characters may be printed while the printhead 24 is moved across the paper from left to right and the next line of characters may be printed while the printhead 24 is moving in the opposite direction, namely, from right to left across the paper. This type of printing requires the use of a data storage mechanism for storing the dot data for complete line of characters so that such data can be supplied to the printhead 24 in a reverse manner when the printing is being done in the reverse direction, namely, from right to left. This is usually accomplished with the use of modern high-speed microcomputer circuitry.

In passing, it should be noted that the wire matrix printer of FIG. 1 is not limited to the case of printing text type characters. I can also be used to print graphical and pictorial type images on the paper 40. All that is required is to fire the appropriate print wires at the appropriate times to cause the resulting dot patterns to create the desired image. In this case, where an image extends over several print lines, the accurate placement of the dots becomes very critical. If the image dots on one print line are not properly placed relative to the image dots on the other print lines, the resulting image will be distorted.

The wire fire control method of the present invention is based on the usage of uniquely-defined targets. These targets are not dependent on and are not limited to the fixed points defined by the emitter signals produced by the position marking mechanism associated with the printhead. These targets and the manner in-which they are manipulated provide the key to the sophistication of the present invention and also indicate its inherent simplicity.

Figure 2:
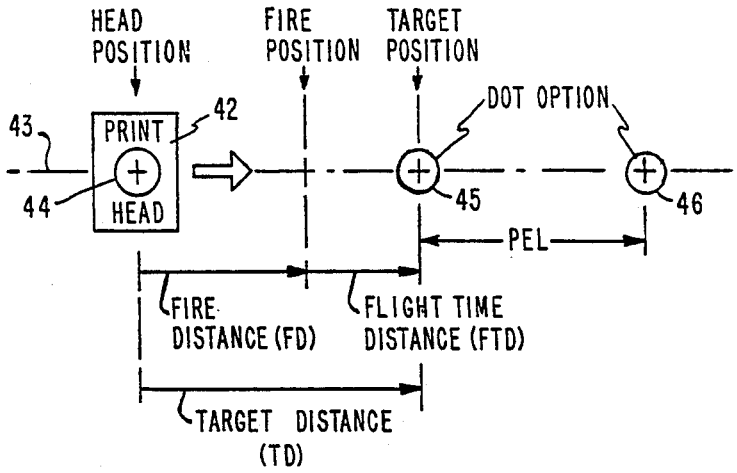
FIG. 2 is a diagram used in explaining the operation of the present invention.

The diagram of FIG. 2 will be used to explain the basic concepts and to define the terms used in describing same. FIG. 2 shows a printhead 42 which moves horizontally from left to right across a print line 43. Printhead 42 includes a print wire 44, the length of which is perpendicular to the plane of the paper. Only the end of the print wire is shown in FIG. 2. When fired, the print wire 44 moves toward the paper at right angles to the plane of the paper. Print wire 44 can, if desired, print dots at dot option positions 45 and 46. A dot option or simply "option" is a position at which a dot can be printed if the particular character or other image being formed calls for a dot at that position. If the image being formed does not have a dot at that position, then the print wire is not fired and that option is left unprinted. The distance between successive dot options is called the "pel". This pel value will be different for different character fonts having different dot densities.

Three positions are of interest relative to the movement of the printhead 42. These are the head position (HP), the fire position (FP) and the target position (TP). The position values are measured along the length of the platen 23 with one end of the platen, usually the left-hand end, being taken as the starting or reference position for measurement purposes. It will be assumed herein that the position measurements are made relative to the left-hand end of the platen 23 and that the numerical position values increase from left to right across the platen 23.

The head position is the actual position of the printhead along the platen 23. More precisely, it is the position of the print wire 44 and not the printhead 42 which is of interest, but for simplicity of explanation, the terms "head position" and "printhead position" will be used when what is really meant is the "print wire position". In this regard, what is meant by print wire position is the position of the geometrical center point of the end of the print wire.

The fire position is the position at which the print wire should be fired in order for the end of the print wire to strike the paper at the target position. The target position is the position of the next dot option to be encountered by the print wire being considered. More precisely, the target position is the geometrical center point of the next dot option.

The target distance (TD) is the distance from head (wire) position to the target position. The fire distance (FD) is the distance from the head (wire) position to the fire position when the printhead is on the upstream side of the fire position. The flight time distance (FTD) is the distance from the fire position to the target position. This flight time distance is the distance the printhead will move during the time interval between the time the print wire is fired and the time the print wire will strike the paper, or in other words, the time interval during which the print wire is in flight from the printhead to the paper.

The flight time is a constant for any given printhead construction and any given gap distance or separation distance between the printhead and the paper being printed on. This flight time is typically somewhere in the range of 350 to 400 microseconds, with a flight time of 370 microseconds being a representative value.

The flight time distance, on the other hand, is not a constant value. It is dependent -upon and varies with the speed or velocity of movement of the printhead along the print line. The greater the speed of the printhead, the greater is the flight time distance and vice versa. The fire distance is also speed dependent since it represents the difference between the target distance and the speed dependent flight time distance. As the flight time distance increases, the fire distance decreases and vice versa.

When the printhead 42 reaches the first target position, namely, the position of the first dot option 45, a new target position is established and used. This new or next target position is the position of the next dot option 46. A new fire position is also determined, this new fire position being intermediate the two dot options 45 and 46. This process of establishing a new target position and a new fire position is repeated when the printhead 42 reaches the second dot option 46 and each subsequent dot option in any given segment of printing.

The first dot option in any given segment of printing can be located at any desired position along the print line 43. The position of this first dot option is not dependent on or limited to the fixed points defined by the position marking emitter signals. For any given character font and, hence, any given dot option density, the distance between successive dot options is a fixed value which is called the "pel". This pel value is also not dependent upon the fixed points defined by the emitter signals. The pel value does not have to be a whole number multiple of the emitter signal spacing. Neither the first dot option nor any of the subsequent dot options in any given segment of printing need be located at the fixed points defined by the emitter signals. They may be, but they need not be. The various position and distance values used herein are expressed in whole and fractional emitter units. In the embodiment described herein this is accomplished by expressing these values in emitter subunits where each subunit is equal to 1/24th of an emitter unit.

Figure 3:
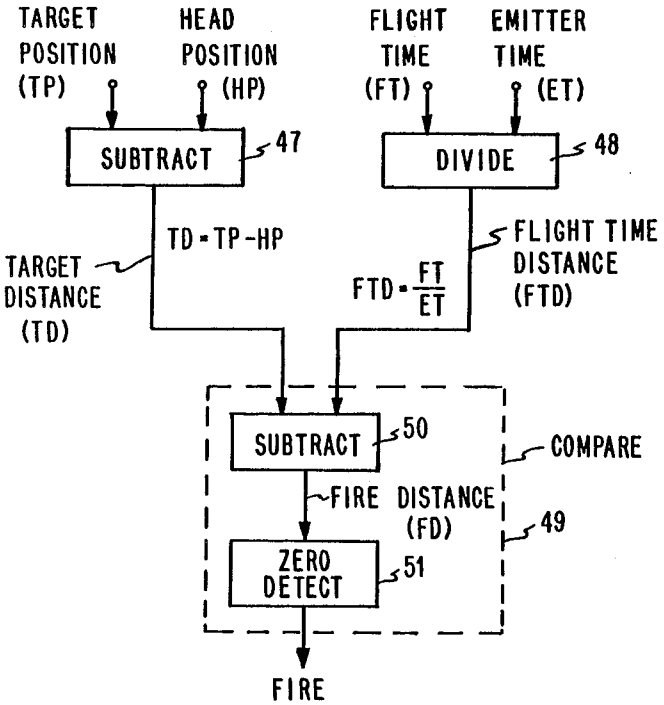
FIG. 3 is a functional block diagram of a first embodiment of a wire fire control mechanism constructed in accordance with the present invention.

Referring to FIG. 3, there is shown the primary features of a wire fire control mechanism constructed in accordance with a first embodiment of the invention. For convenience, this FIG. 3 embodiment will be referred to as a "relative" position embodiment because the portion of the printhead relative to the target position (target distance) is used to determine the firing of the print wire. This embodiment includes means for tracking the target distance, namely, the distance between the print wire position and the position at which a dot is to be printed on the print receiving medium which, for sake of example, is assumed to be paper. By "tracking" is meant measuring or monitoring this distance on a continuous basis as the printhead moves across the print receiving paper. This means for tracking the target distance includes a subtraction mechanism 47 for subtracting a head position signal (HP) from a target position (TP) signal to provide a target distance signal (TD) when the printhead is moving from left to right. This is for the present embodiment wherein the position numbering system starts at the left side of the printer and the position values increase from left to right across the printer platen. In such case, the target position will have a higher numerical value than the head position. This left-to-right numbering convention will be used throughout the remainder of this patent application.

For calculation purposes, it is desired that the target distance always have a positive value. Accordingly, when the printhead is moving in the opposite direction, namely, from right to left, the subtraction process is reversed so that the lower-valued target position is subtracted from the higher-valued head position. In other words, as used in this description, the target distance is a positive value representing the difference between the head and target positions.

In the preferred implementation, both the target position and the head position are supplied to the subtraction mechanism 47 in the form of plural-bit binary data signals and the subtraction operation is performed by the arithmetic and logic unit (ALU) in a microprocessor. In this case, the target distance is also in the form of a plural-bit binary data signal.

The target position signal specifies the next dot option at which a dot may be printed on the paper. This signal is provided by the system logic based on the parameters specified by the user. Initially, it represents the position of the first dot option in a given segment of printing. When the first dot option position is reached by the printhead, the target position's value is updated by the pel value to provide the target position for the next dot option.

The head position signal is provided by the emitter mechanism associated with the printhead drive system. Typically this emitter mechanism includes a bi-directional (up-down) counter for counting the position marking pulses generated by the emitter mechanism. This counter counts in the upward direction when the printhead is moving from left to right and counts in the downward direction when the printhead is moving in the opposition direction from right to left. Thus, the head position signal represents the actual position of the printhead at any given instant.

The embodiment of FIG. 3 further includes means for determining the flight time distance, namely, the distance the printhead will move during the time interval between the time the print wire is fired and the time the print wire will strike the print receiving paper. This flight time distance determining means includes a divider mechanism 48 for dividing a flight time value by an emitter time value to produce the flight time distance value. In the preferred implementation, all three of these values, namely, the flight time value, the emitter time value and the flight time distance are in the form of plural-bit binary data signals and the dividing operation is performed by the arithmetic and logic unit of a microprocessor.

The flight time is the time required for the print wire to move from its at rest position to its paper striking position. It is expressed in microseconds with a value of 370 microseconds being representative. For any given printhead construction over any short term time interval, the flight time is a constant value. It may change slightly over a long period of time as the printhead undergoes continued wear and tear. It may also change slightly when the printer is used in other than a normal operating environment. In either case, the flight time value can be modified to reflect the change. For present purposes, the flight time value will be assumed to be a constant.

The emitter time, on the other hand, represents a measurement of the speed of movement of the printhead from left to right or right to left, as the case may be, across the paper being printed on. The emitter time represents the time required for the printhead to move from one emitter marking point to the next emitter marking point. In other words, the emitter signals represent fixed increments of movement of the printhead across the paper and the emitter time is the time required for the printhead to make one of these fixed increments of movement. Thus, the emitter time is the inverse or reciprocal of the printhead speed. The faster the printhead speed, the smaller is the emitter time. Conversely, the slower the printhead speed the larger is the emitter time.

In the present embodiment, the emitter time is also measured in microseconds. The divider mechanism 48 divides the flight time by the emitter time to produce the flight time distance signal. The flight time represents microseconds, while the emitter time represents microseconds per unit distance. Thus dividing the one by the other yields the number of unit distances and fractions thereof represented by the flight time. In this application, the unit distance is called an "emitter". Thus, the flight time distance is expressed herein as the number of emitters and fractions thereof the printhead will move while the print wire is in flight to the paper. This flight time distance varies as a direct function of the printhead speed. The faster the printhead speed, the greater is the flight time distance and vice versa.

An observation of interest is that if the printhead is moving very slowly, then the flight time distance becomes very small and may perhaps be ignored. For the range of speeds covered by the present invention, this flight time distance is not negligible and needs to be taken into account.

The FIG. 3 embodiment also includes means for firing the print wire when the target distance becomes substantially equal to the flight time distance. This means for firing the print wire is represented by a comparison mechanism 49 which compares the target distance signal with the flight time distance signal and produces a wire fire signal at its output when the two input signals become of equal value. The comparison mechanism 49 may include, for example, a subtraction mechanism 50 and a zero detection mechanism 51. When the difference between the two input signal values become zero, the zero detector 51 produces a wire fire output pulse. If a dot is to be printed at the dot option in question, then this wire fire pulse causes current to be supplied to the actuator coil for a particular print wire and the wire is fired to produce an ink dot on the print receiving paper.

In the preferred implementation, the subtraction operation of the mechanism 50 is performed by the arithmetic and logic unit (ALU) in a microprocessor and the zero detection function is performed by the ALU condition testing circuitry which is normally used to detect the occurrence of a zero value output from the ALU.

The FIG. 3 embodiment is called a relative position embodiment because the target distance produced by the subtraction mechanism 47 represents the position of the printhead relative to the target.

Figure 4:
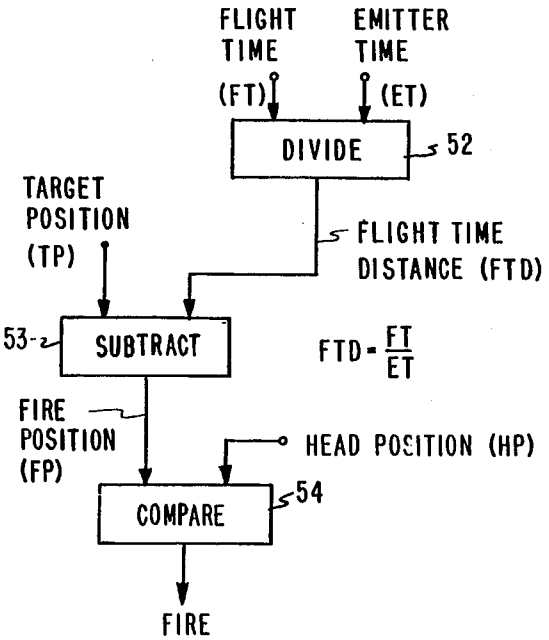
FIG. 4 is a functional block diagram of a second embodiment of a wire fire control mechanism constructed in accordance with the present invention.

Referring now to FIG. 4, there is shown the principal features of a different embodiment of a wire fire control mechanism constructed in accordance with the present invention. For convenience, this embodiment is referred to as an "absolute" position embodiment because the absolute position of the printhead is used to determine the firing of the print wire. This embodiment includes a divider mechanism 52 which is responsive to the flight time signal and to the emitter time signal for producing the flight time distance signal. This is the same as before. This embodiment also includes a subtraction mechanism 53 which is responsive to the target position signal and the flight time distance signal for producing a fire position signal A comparison mechanism 54 is used to compare the absolute head position signal with the fire position signal. The comparison mechanism 54 produces a wire fire output pulse when the position of the moving printhead becomes equal to the fire position.

The target position signal is updated to reflect the next target position when the printhead reaches the current target position. The emitter time is monitored on a continuous basis so that the flight time distance signal at any given instant is the correct value for the printhead speed at that instant.

In the preferred implementation, all signals shown in FIG. 4, except the wire fire output of the comparison mechanism 54, take the form of plural-bit binary data signals. The divide, subtract and compare operations of FIG. 4 are preferably performed by the arithmetic and logic unit of a microprocessor.

Figure 5:
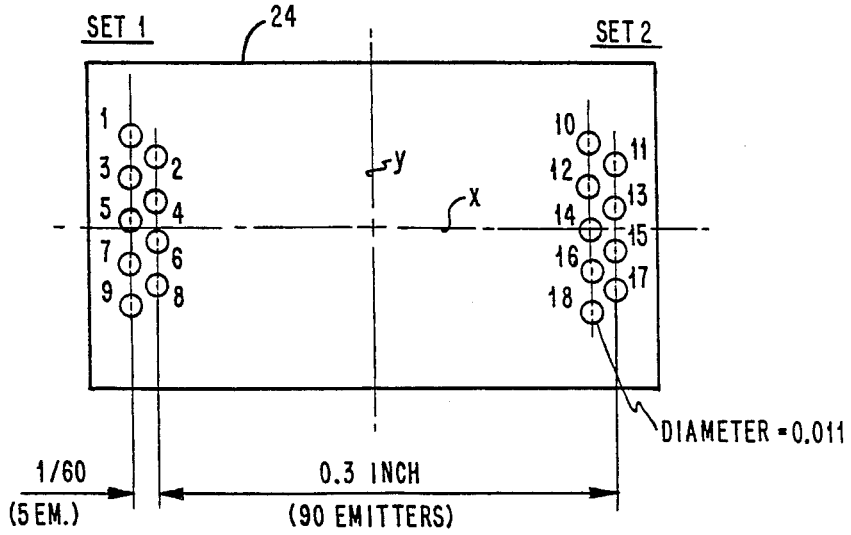
FIG. 5 is a front elevational view of the end of a printhead which is nearest to the platen of the printer.

Referring to FIG. 5, there is shown an elevational view of the printing end of the printhead 24 of FIG. 1. This is the end of the printhead which faces and is closest to the platen 23 and, hence, the paper 40 of FIG. 1. The surface of this printing end is maintained in a plane parallel to the printing surface of the platen 23 and is spaced apart a short distance from the platen 23. This particular printhead includes two sets of print wires, identified as "Set 1" and "Set 2" Compared to the diameters of the print wires, these two sets are spaced apart a relatively large distance along a horizontal axis x. The vertical axis is represented by reference letter y. The horizontal axis x extends parallel to the longitudinal axis of the platen 23. The vertical y axis extends in the direction the paper is fed when it is advanced from one line to the next.

The ends of the print wires in Set 1 are identified by reference numerals 1–9, while the ends of the print wires in Set 2 are identified by reference numerals 10–18. When a print wire in the view of FIG. 5 is fired, it moves outwardly toward the reader in a direction which is perpendicular to the plane of the paper in FIG. 5.

Each set of print wires has first and second groups of print wires which are spaced apart a relatively small horizontal distance. The print wires in the first group in Set 1 are numbered 1, 3, 5, 7 and 9. There are five print wires in this first group. The print wires in the second group of Set 1 are numbered 2, 4, 6 and 8. There are four wires in this second group. The print wires in the first group of Set 2 are numbered 10, 12, 14, 16 and 18. There are five print wires in this first group. The print wires in the second group of Set 2 are numbered 11, 13, 15 and 17. There are four print wires in this second group.

The ends of the print wires in any given group are in vertical alignment with one another, that is, they are disposed along an axis that runs parallel to the y axis. The vertical locations of the ends of the print wires in each second group are staggered relative to the ends of the print wires in their respective first group. Thus, the center point of wire 2 is vertically positioned intermediate the center points of wires 1 and 3, etc. Similarly, with respect to Set 2, each wire in the second group is vertically positioned midway between the center points of the two neighboring wires in the first group. Also, as will be better seen from a later figure, wire 10 is not in horizontal alignment with wire 1, wire 11 is not in horizontal alignment with wire 2, etc. The center points of the wires in Set 2 are vertically displaced relative the center points of the wires in Set 1 so that they are located midway between the center points for the Set 1 wires (see FIG. 9).

Some representative dimensions will now be given with the clear understanding that they are by way of example only. Thus, a representative value for the diameter of each print wire is 0.011 of an inch. A representative value for the horizontal distance between like groups in the two sets is 0.3 of an inch. In other words, the spacing between the vertical axis for the second group of wires in Set 1 and the vertical axis for the second group of wires in Set 2 is 0.3 of an inch. The spacing or distance between the vertical axes of the first and second groups in the same set is one sixtieth (1/60) of an inch. The corresponding decimal value is approximately 0.017 of an inch.

The basic unit of distance measurement used throughout this application is the "emitter". In a representative implementation of this invention, the value of the emitter was chosen to be one three-hundredths (1/300) of an inch. This is approximately 0.003 of an inch. Another way of looking at it is that one inch of movement by the printhead across the print line causes the emitter mechanism associated therewith to produce 300 emitter pulses. This representative value of 300 emitter pulses per inch is the assumed value that will be used throughout the remainder of the description portion of this patent application. In this case, the horizontal spacing between corresponding groups in the two print wire sets is 90 emitters, while the horizontal spacing between the two groups of wires in the same set is 5 emitters.

The wire fire control method of the present invention enables the construction of a wire matrix printer which is capable of printing a wide variety of different character fonts. Typically, the different character fonts have different dot densities for the printed characters. Also for any given character font, different character pitches or characters per inch can be provided.

Figure 6:
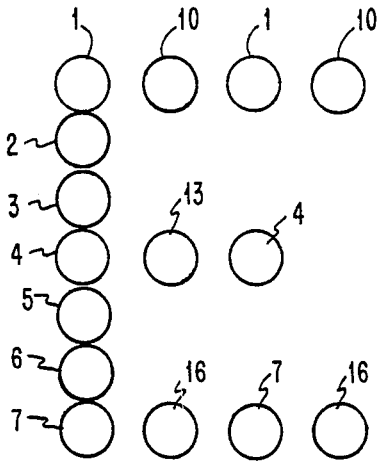
FIGS. 6 and 7 show the same alphabetical character printed in two different character fonts with the present invention.
Figure 7:
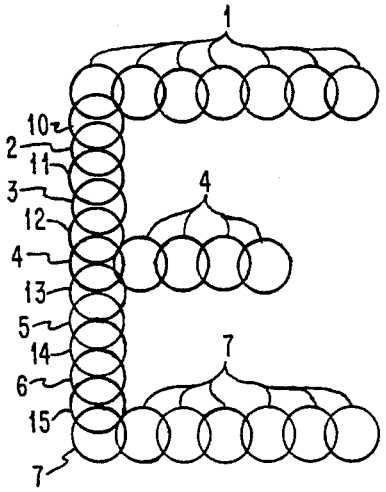

FIGS. 6 and 7 show examples of the letter E printed in two different character fonts using the printhead of FIG. 5. The reference numerals for the individual dots in FIGS. 6 and 7 indicate which print wires of the FIG. 5 printhead printed the dots. The character font for FIG. 6 is called a "data processing" or DP quality font. The dot density is less and this font can be printed at a higher speed of movement of the printhead across the printed page. The character font for FIG. 7 is called a "near letter quality" or NLQ font. The dot density in both the vertical and horizontal directions have been doubled relative to FIG. 6 and the improved quality of the printed character is apparent. The printhead is moved at a slower speed when printing the FIG. 7 font.

Figure 8:
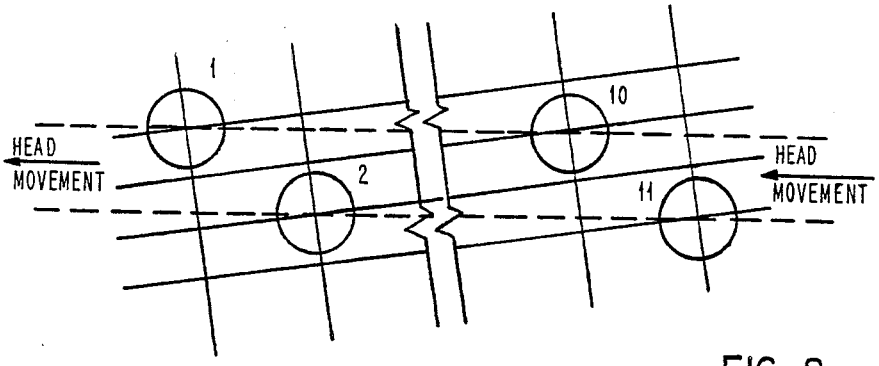
FIGS. 8 and 9 show different rotational positions for tee printhead of FIG. 5.
Figure 9:
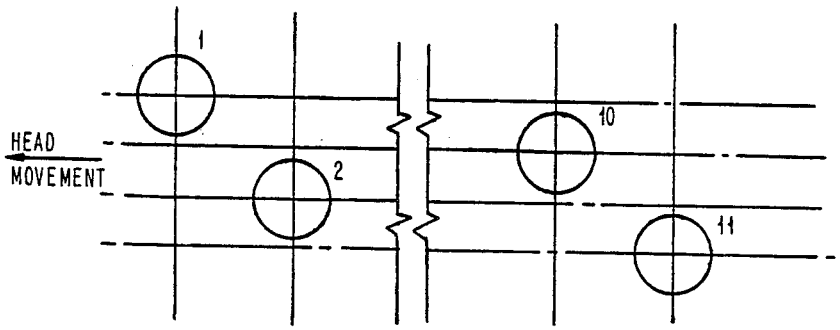

Another difference between the fonts of FIG. 6 and 7 is the manner in which the FIG. 5 printhead is used. This difference is indicated in FIGS. 8 and 9. To print the character font of FIG. 6, the print head of FIG. 5 is rotated slightly to bring the print wires in Set 2 into horizontal alignment with the corresponding print wires in Set 1. Thus, wire 10 is brought into horizontal alignment with wire 1, wire 11 is brought into horizontal alignment with wire 2, etc. The angle of rotation required to accomplish this is approximately 1.3 degrees. With reference to FIG. 6, this horizontal alignment of the two sets of print wires enables, for example, wires 1 and 10 to both participate in printing the dots across the top leg of the letter E. In this mode of operation, the two sets of print, wires are equivalent to two identical but spaced apart print heads. This enables a doubling of the printhead movement speed relative to what can be accomplished with a single set of print wires.

FIG. 9 shows the printhead angular orientation for printing the near letter quality font of FIG. 7. The FIG. 9 orientation is also used for printing graphic images. In the FIG. 9 case, the print wires of the second set are vertically staggered relative to the print wires of the first set. Thus, for example, the center point of print wire 10 is vertically positioned midway between the center points for print wires 1 and 2. This vertical staggering of the print wires in the two sets enables the vertical dot density to be doubled without having to move or shift the paper in a vertical direction.

The print wire configuration of FIG. 5 and the character font examples of FIGS. 6 and 7 illustrate the complexities that can be accommodated by wire fire control mechanisms constructed in accordance with the present invention. The wire fire timing methods of the present invention provide the added flexibility needed to accommodate complex timing requirements.

In general, different character fonts have different dot density requirements. Different dot densities have different upper limits for the speed of movement of the printhead across the paper. Since the usual objective is to print characters as rapidly as possible, this means that different printhead speeds should be used for the different dot densities. The present invention is particularly well suited for use with a variety of different printhead speeds.

The following table shows the optimum printhead speeds and other operating parameters for a representative group of character fonts. These operating parameters can be accommodated by the present invention. For sake of example, they will be assumed to be representative of the parameters used by the detailed embodiment of the invention to be described herein.

| MODE | CPI | OPTION DISTANCE INCHES | OPTION DISTANCE EMITTERS | OPTIONS PER INCH | SPEED (IPS) | μSEC. PER OPTION | μSEC. PER EMITTER | FTD |
|---|---|---|---|---|---|---|---|---|
| DP | 10 | 0.0100 | 3.0 | 100 | 40.00 | 250 | 83 | 4.44 |
| DP | 12 | 0.0083 | 2.5 | 120 | 33.33 | 250 | 100 | 3.70 |
| DP | 15 | 0.0067 | 2.0 | 150 | 26.67 | 250 | 125 | 2.96 |
| TEXT | 10 | 0.0050 | 1.5 | 200 | 20.00 | 250 | 167 | 2.22 |
| TEXT | 12 | 0.0042 | 1.25 | 240 | 16.67 | 250 | 200 | 1.85 |
| TEXT | 15 | 0.0033 | 1.00 | 300 | 13.33 | 250 | 250 | 1.48 |
| NLQ | 10 | 0.0050 | 1.5 | 200 | 10.00 | 500 | 333 | 1.11 |
| NLQ | 12 | 0.0042 | 1.25 | 240 | 8.33 | 500 | 400 | 0.92 |
| NLQ | 15 | 0.0033 | 1.00 | 300 | 6.67 | 500 | 500 | 0.74 |

The items in the MODE column denote different print qualities. The DP mode is the data processing mode and represents the lowest quality in this particular example. It is the one represented in FIG. 6. The NLQ mode is the near letter quality mode and represents the highest quality in this particular example. It is the one represented in FIG. 7 wherein the dot density is doubled in both the horizontal and vertical directions. The text quality mode is an intermediate mode wherein the dot density is doubled only in the horizontal direction. In this text quality mode, the printhead is oriented as shown in FIG. 8 and the printhead speed is reduced to one half the speed used for the DP mode.

The CPI column shows different pitch or characters per inch values. Pitches of 10, 12 and 15 characters per inch are provided for each of the three quality modes.

The option distance is shown in both inches and emitter units. The option distance is the distance between successive dot option positions. One emitter unit is equal to one three-hundredths (1/300) of an inch. The speed column gives the speed of movement of the printhead as it moves across the page. The speed values given are in inches per second (IPS).

The "SEC PER OPTION" column gives the time in microseconds required for the printhead to move from one dot option position to the next. The "SEC PER EMITTER" column gives the time in microseconds between the occurrence of the leading edges of successive emitter pulses. These values are the emitter time (ET) values previously mentioned. They are inversely proportional to the printhead speed.

The ITD column shows the flight time distance values for an assumed print wire flight time of 300 microseconds. This flight time distance is expressed in emitter units. For the case of DP mode with 10 characters per inch, for example, the printhead will move a distance of 3.6 emitters while the print wire is in flight from the printhead to the paper. As previously mentioned, the flight time distance is dependent upon the speed of movement of the printhead.

The foregoing table is a representative example of some of the character fonts that can be accommodated by a wire fire control mechanism constructed in accordance with the present invention.

Figure 10:
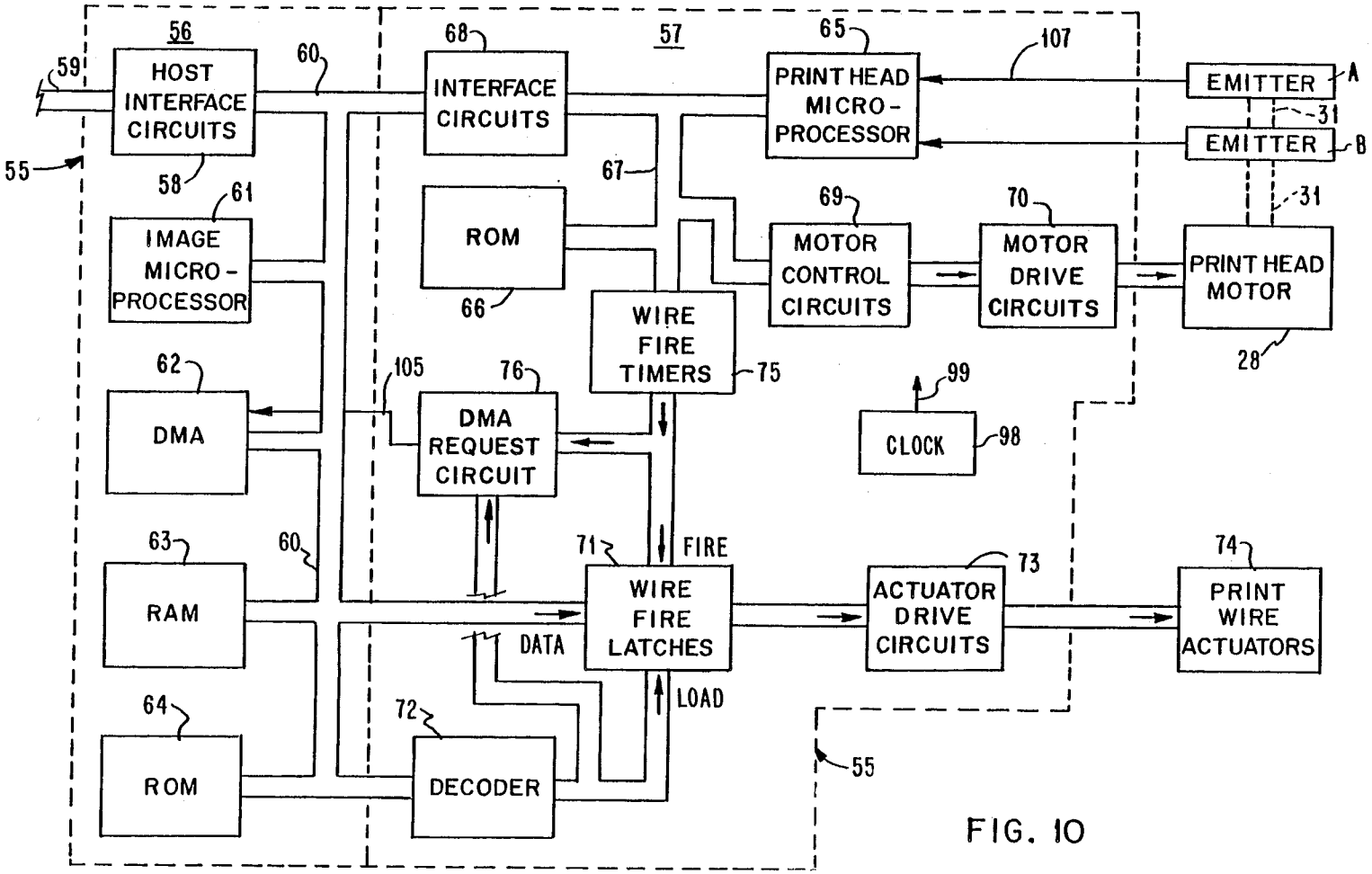
FIG. 10 is a schematic block diagram of a digital controller for a wire matrix printer wherein such digital controller includes a wire fire control mechanism constructed in accordance with the present invention.

Referring now to FIG. 10, there is shown a schematic block diagram showing the primary features of a complete digital controller 55 for a wire matrix printer. Included in this controller 55 is a representative embodiment of a wire fire control mechanism constructed in accordance with the present invention. The controller 55 includes an image data processing portion 56 and a printhead control portion 57.

The image data processing portion 56 receives the higher level image information from a host computer or host data processing equipment to which the printer is connected and converts it into the elemental dot data which is used to control the firing of the print wires in the printhead. The image data processing portion 56 includes host interface circuits 58 which are connected by way of a multiconductor cable 59 to the host computer. The host interface circuit 58 are, in turn, coupled to a multiconductor image processor bus 60 which interconnects various data processing elements in the image processing section 56. These data processing elements include an image microprocessor 61, a direct memory access (DMA) unit 62, a read/write random access memory (RAM) unit 63 and a read only memory (ROM) unit 64.

The image microprocessor 61 may be, for example, an Intel-80188 high integration 8 bit microprocessor currently manufactured by the Intel Corporation of Santa Clara, Calif. As such, it includes an arithmetic and logic unit (ALU), various general purpose registers, various control registers, an interrupt controller, a bus interface unit, several programmable timers, and the like. The ROM unit 64 includes the microcode which controls the operation of the image microprocessor 61. It also includes the print wire image patterns for several different character fonts.

The RAM unit 63 is subdivided or partitioned into various working areas and buffer areas which are used during different phases of the image data processing operations. RAM 63 includes, for example, an incoming data buffer area for receiving the high level information from the host computer. It also includes an output buffer area for temporarily holding the wire image data which tells the print wires when to print and when not to print. It also includes various working areas which are used for creating composite images, for holding the results of intermediate data processing operations, for assembling various data and control elements into unique print task groupings, and the like.

The DMA unit 62 is used for automatically extracting the wire image data from the output buffer in RAM 63 and supplying it to the printhead control portion 57 without having to interrupt the image microprocessor 61. For the case of an Intel 80188 microprocessor, the DMA unit is actually included as part of the microprocessor chip. The DMA unit is shown separately herein because other types of microprocessors may be used which don't include it on the microprocessor chip.

As an example of one of the various modes of operation of the image data processing section 56, it is assumed that it is desired to print text material using one of the predefined character fonts which is built into the ROM 64. In this case, the host computer sends over a command which tells the image processing section the particular character font which is to be used. The microprocessor 61 thereafter uploads a copy of the selected font from the ROM 64 into an active font table portion of the RAM 63. Thereafter, the host computer commences to send over code point signals which identify the characters to be printed. Each code point signal is a one byte character code which identifies a particular character to be printed. In response to these code point signals, the microprocessor 61 extracts the appropriate wire image dot data from the active front table in RAM 63 and puts it into the output buffer are of RAM 63. This dot data is thereafter transferred in an option position by option position manner to the printhead control section 57 as needed. This transfer is accomplished by means of the DMA unit 62.

It is not required to use the preselected character fonts which are built into the ROM 64. The wire image data for an alternative character font may instead be sent over cable 59 from the host computer to enable the printing of characters in an alternative font style. Graphical image information, as opposed to text type character information, may also be supplied by the host computer to the image data processing section 56.

The printhead control section 57 includes a printhead microprocessor 65 for controlling the movement of the printhead across the paper and for controlling the firing times for the print wires. This printhead microprocessor 65 may take the form of, for example, an Intel 8031 8-bit microprocessor currently manufactured by Intel Corporation of Santa Clara, Calif. As such, it includes an arithmetic and logic unit (ALU), various general purpose and special purpose registers, a programmable input/out (I/O) unit and two programmable 16-bit timers. Associated with the printhead microprocessor 65 is a read only memory (ROM) unit 66 which contains the microcode which causes the microprocessor 65 to perform the various control functions. The microprocessor 65 and ROM 66 are each coupled to a common multiconductor printhead processor bus 67. This bus 67 is also coupled to interface circuits 68 which are also coupled to the image processor bus 60.

Interface circuits 68 are used to transfer plural-bit (e.g., 8-bit) command signals from the image microprocessor 61 to the printhead microprocessor 65 and to transfer plural-bit (e.g., 8-bit) status signals from the printhead microprocessor 65 to the image microprocessor 61. Interface circuits 68 include a plural-stage command register into which a command byte can be loaded by the image microprocessor 61 and from which the same command byte can be read by the printhead microprocessor 65. Interface circuits 68 also include a plural-stage status register into which can be loaded a status byte from the printhead microprocessor 65 and from which can be read the same status byte by the image microprocessor 61. Appropriate latch circuits are included for providing a status pending interrupt to the image microprocessor 61 and a command pending interrupt to the printhead microprocessor 65.

The command bytes supplied to the printhead microprocessor 65 are of two general types. One type tells the printhead microprocessor 65 what to do. The other type supplies to the printhead microprocessor 65 various operating parameters such as printhead speed, dot option spacing, and the starting and stopping positions for a particular segment of printing.

One function of the printhead microprocessor 65 is to control the direction and speed of movement of the printhead 24 of FIG. 1. This is accomplished by controlling the speed and direction of rotation of the printhead motor 28 which, via the drive belt 34, causes movement of the printhead carriage 25 across the print receiving paper 40. Coupled to the shaft 31 of the printhead motor 28 are the rotary elements of a pair of emitter mechanisms A and B shown in FIG. 10. Each of the emitter mechanisms A and B is a rotary encoder which generates pulses at regular intervals as its rotary element rotates. These encoders may be, for example, of the optical type.

Figure 11:
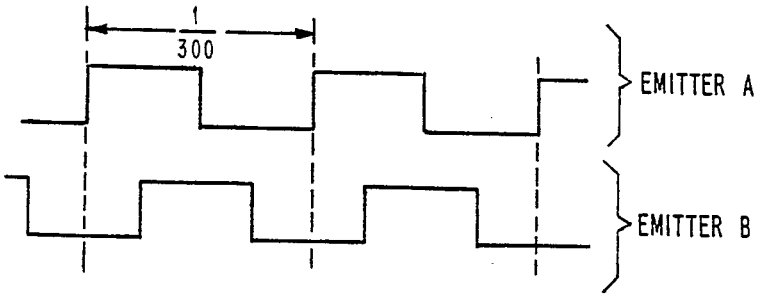
FIG. 11 is a timing diagram illustrating the emitter signals generated in the apparatus of FIG. 10.

The output pulses produced by the emitter mechanisms A and B are shown in FIG. 11. These pulses are sometimes referred to herein as emitter signals. The signal from emitter B is identical to the signal from emitter A except that it is shifted in phase by a factor of 90 degrees relative to the signal from emitter A. One of these emitter signals is sufficient for determining printhead position and speed. The use of the second emitter signal enables a determination of the direction of movement of the printhead. The construction of the drive system for the printhead carriage 25 and the spacing of the signal producing elements in each emitter mechanism are such that the duration of each emitter signal cycle corresponds to a printhead movement distance of one three-hundredths (1/300) of an inch. In other words, the printhead 24 must move a horizontal distance of 1/300 of an inch across the paper in order to produce one complete emitter cycle. This emitter signal distance (1/300 inch) is used herein as the basic unit of distance measurement.

One of the functions of the printhead microprocessor 65 is to monitor the printhead speed by measuring the time duration- of each complete emitter signal cycle. If the measured speed does not agree with the desired speed established by a speed parameter value obtained from the image microprocessor 61, then an appropriate signal is supplied to motor control circuits 69 for adjusting the speed of the printhead motor. Motor control circuits 69 supply control signals to motor drive circuits 70 which control the direction and magnitude of the current flow through the windings of the printhead motor 28. If the actual printhead speed does not agree with the desired printhead speed, then the speed determining control signal supplied to the motor control circuits 69 is adjusted to decrease the amount of disagreement between the actual and desired speeds.

A second primary function of the printhead microprocessor 65 is to control the generation of wire fire timing pulses which determine the permitted firing times for the print wires. More particularly, a plurality of wire fire latches 71 are provided for receiving the image dot data from the image processing section 56. For the moment, it will be assumed that there is one wire fire latch for each print wire. Since, as shown in FIG. 5, there are eighteen print wires, this means that there will be eighteen individual wire fire latches. Each latch contains either a binary one value or a binary zero value, depending upon whether or not its associated print wire is to print a dot at the next occurring dot option position. This dot option data is loaded into the wire fire latches 71 from the output buffer section in the RAM 63 by way of the image processor bus 60 which is connected to the data input of the wire fire latches 71. The loading of the data is controlled by a decoder 72.

The outputs of the wire fire latches are connected to individual ones of a plurality of actuator drive circuits 73. These actuator drive circuits 73 are, in turn, connected to the individual ones of the print wire actuators 74. There is a different individual actuator for each print wire. In a ballistics type printhead, each actuator is comprised of a pivoted lever arm and a solenoid or coil which is positioned to cause movement of the lever arm. One end of the lever arm is positioned against the back end of the print wire and the other end of the lever arm is positioned over the coil. This other end of the lever arm is composed of ferromagnetic material. When the coil is energized with current, the end of the lever arm adjacent the coil is abruptly pulled against the pole piece of the coil. This causes the other end of the lever arm to apply an abrupt driving force to the back end of the print wire to cause the print wire to fly forward toward the paper. A return spring is provided for returning the print wire to its at rest position when the current is removed from the coil. In use, the current is removed shortly before the print wire strikes the paper so that when the print wire strikes the paper it can bounce back toward its at rest position.

The outputs of the wire fire latches 71 are normally disabled so that none of the print wire actuators are energized. The outputs of the wire fire latches 71 are periodically enabled by timing pulses generated by wire fire timers 75. When a timing pulse or wire fire pulse enables the output of a particular wire fire latch, such latch will cause activation of its associated print wire actuator if and only if the data value stored in the latch is a binary one value. If a binary zero value is stored in the latch, then its print wire actuator will not be activated. A wire fire pulse from timers 75 determines a point in time at which the print wire is capable of being fired. Whether or not it is actually fired at this point in time is determined by the dot image data value residing in its wire fire latch.

If a binary one value is in the wire fire latch, the enabling of the latch output by a firing pulse from timers 75 causes a pulse which is coincident in time with the fire pulse from the timers 75 to be supplied to the associated actuator drive circuit. In response to this pulse, the associated actuator drive circuit supplies energizing current to the associated print wire actuator for the duration of this pulse.

After the fire pulse applied to a particular wire fire latch has terminated, such latch needs to be provided with a new data value to get ready for the occurrence of the next dot option. The supplying of new dot image data to the wire fire latches 71 is controlled by a DMA request circuit 76. As the data in the latches 71 is used up, request signals are supplied by the request circuit 76 to the DMA unit 62 to cause the DMA unit to access new data from the output buffer portion of RAM 63 and to supply appropriate address signals to decoder 72 to cause such data to be loaded into the latches 71. This, of course, is a continuing process as the printhead moves across the paper. New data is supplied to the wire fire latches 71 for each new dot option position encountered by the printhead.

Figure 12:
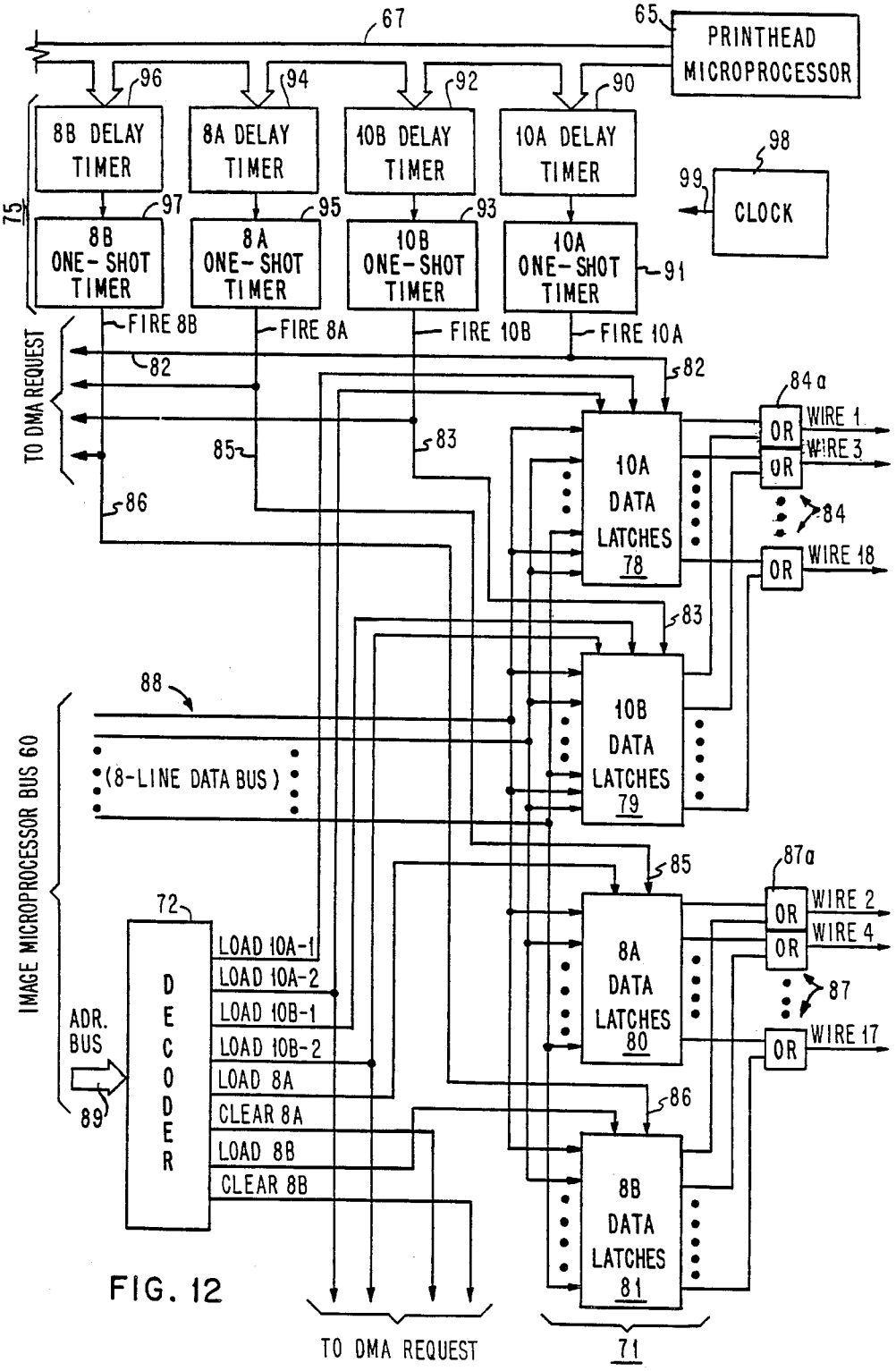
FIG. 12 shows in greater detail the construction of the wire fire timers and the wire fire latches of the FIG. 10 apparatus.

Referring to FIG. 12, there is shown in greater detail the construction of the wire fire latches 71 and the wire fire timers 75 of FIG. 10 for the case of the 18-wire printhead of FIG. 5. The wire fire latches 71 include data latches 78, 79, 80 and 81. For reasons that will be explained hereinafter, two data latches are provided for each of the 18 wires. Thus, there are a total of 36 data latches.

For firing purposes, the first group of print wires (wires 1, 3, 5, 7 and 9) of Set 1 are combined with the first group of print wires (wires 10, 12, 14, 16 and 18) of Set 2. Both first groups are five-wire groups. Thus, for both first groups as a whole, there is a total of 10 print wires. First, multistage data latch means are provided for receiving the image dot data for these 10 print wires. This latch means is represented by data latches 78 and 79. Data latches 78 include 10 individual latch circuits, one for each of the 10 print wires in the two first groups. The outputs of these 10 latches are simultaneously activated or enabled by a 10A wire fire timing pulse supplied thereto from wire fire timers 75 by way of conductor 82. Data latches 79 are also comprised of 10 individual latch circuits, there being a separate one for each of the 10 different print wires in the two first groups. The outputs of the 10 latch circuits in data latches 79 are simultaneously activated or enabled by a 10B wire fire timing pulse supplied by way of conductor 83.

The use of two sets (10A and 10B) of data latches 78 and 79 provide two individual latch circuits (A and B) for each of the 10 print wires, one such latch circuit (A) being provided by the latch set 78 and the other such latch circuit (B) being provided by the latch set 79. The outputs of the corresponding latch circuits in the two sets are coupled together by means of a corresponding one of a set of OR circuits 84. The output of each of the different OR circuits 84 drives a different one of the print wires. For example, the output of the first latch circuit in set 78 and the output of the first latch circuit in set 79 are coupled to the two inputs of the first OR circuit **84*a*. The output of this OR circuit 84*a* is, in turn, connected to the actuator drive circuit for print wire 1**.

The provision of two latch circuits for each print wire solves a timing problem which is encountered when the printhead is moving at one of the higher speeds. One of the latch sets 78 and 79 is used for enabling the printing of dots at odd numbered dot option positions, while the other of sets 78 and 79 is used for enabling the printing of dots at the intervening even numbered dot option positions. The control means for accomplishing this are provided by the use of separate sets of wire fire timers, one set being designated as the 10A set and the other set being designated as the 10B set. The corresponding latch sets are also designated as 10A and 10B respectively. The "10" denotes that they are for the 10 first group print wires.

A similar procedure is followed for the second group of print wires in both Set 1 and Set 2. In particular, one or more of second group print wires 2, 4, 6 and 8 can be fired simultaneously with one or more of second group print wires 11, 13, 15 and 17. This is accomplished by means of additional multistage data latch means represented by latch sets 80 and 81, each of which services both second groups of print wires. These second wire groups are four-wire groups, giving a total of eight print wires for the two second groups as a whole. Thus, data latches 80 include eight individual latch circuits which are individually coupled to different ones of the eight print wires which make up the two second groups. The outputs of the eight data latches 80 are simultaneously activated or enabled by an 8A wire fire timing pulse obtained from wire fire timers 75 via conductor 85.

As before, two individual latch circuits are provided for each print wire in each of the two second groups. The second latch circuit for each print wire is provided by one of the eight individual latch circuits in data latches 81. The outputs of the latch circuits 81 are simultaneously enabled by 8B wire fire timing pulse supplied via conductor 86. The corresponding outputs of latch set 80 and latch set 81 are OR'ed together by corresponding ones of OR circuits 87. For example, the outputs of the first latch circuit in set 80 and the first latch circuit in set 81 are connected to the two inputs of the first OR circuit 87*a*. The output of OR circuit 87*a* is connected to the actuator drive circuit for print wire 2.

Data latch sets 80 and 81 are designated as the 8A and 8B sets. The "8" denotes that the latch controls eight print wires. One of the 8A and 8B sets enables the printing of dots at odd numbered dot option positions, while the other of the 8A and 8B sets enables printing of dots at the intervening even numbered dot option positions. The control means for the 8A and 8B latch sets are represented by the 8A and 8B wire fire timer circuits supplying the 8A and 8B timing pulses via the conductors 85 and 86, respectively.

Data latch sets 78–81 can be implemented by using, for example, type LS173 and type LS374 plural-bit integrated circuit latch circuit modules currently manufactured by Texas Instruments Inc. of Dallas, Tex. Both types provide controllable output buffers for enabling and disabling the latch output lines. These are tristate type buffers which place the latch output lines in a tristate or high impedance condition when the outputs are disabled.

Image dot data is loaded into the data latches 78–81 via the image processor bus 60. This bus 60 includes an 8-line data bus portion 88 and a 19-line address bus portion. Three of these address lines are represented by an address bus portion 89 and are connected to the input of decoder 72. The outputs of the decoder 72 are used to control the loading of data into different ones of the data latches 78–81. The data lines in bus portion 88 are connected to the data inputs of the latches 78–81.

Since the 10A and 10B data latch sets 78 and 79 each include ten individual latch circuits, whereas the data bus 88 includes only eight data lines, two different load signals are used for the 10A and 10B latch sets. The load 10A-1 output signal of decoder 72 is used to load the first eight bits of data into the 10A data latches 78, while a load 10A-2 signal from decoder 72 is used to load the remaining two bits into the 10A data latches 78. Thus, two different accesses of the output buffer portion of RAM 63 are required to load the ten data bits into the 10A latches 78. The first access of the RAM output buffer places eight data bits on the 8-line data bus 88 and the accompanying address supplied to the decoder 72 activates the load 10A-1 output of the decoder. During the second access of the RAM output buffer, the remaining two data bits are placed on the data bus 88 and are loaded into the remaining two 10A data latch circuits by the load 10A-2 output of the decoder 72.

In a similar manner, two separate accesses of the RAM output buffer are required to load all ten image dot values into the 10B data latches 79. The load 10B-1 and load 10B-2 pulses from the decoder 72 control the loading of the ten dot image bits into the 10B data latches 79.

The 8A and 8B data latch sets 80 and 81 each require only one access of the RAM output buffer. The load 8A and load 8B signals from decoder 72 respectively control the loading of data from the RAM output buffer into the 8A and 8B latch sets 80 and 81.

Accessing of data from the RAM output buffer is controlled by the DMA unit 62 shown in FIG. 10. The DMA unit 62 supplies a source address to the RAM 63 to tell it the address of the data to be placed on the bus 60. The DMA unit 62 supplies a destination address to the decoder 72 to identify the data latches into which the data on the bus 60 is to be loaded.

The wire fire timers 75 of FIG. 10 include four sets of timers as shown in FIG. 12. A first set is comprised of a 10A delay timer 90 connected to a 10A one-shot timer 91. The delay timer 90 provides a needed (and variable) time delay at the end of which it triggers the one-shot timer 91 to cause it to produce a wire fire timing pulse of fixed duration. This 10A timing pulse is supplied to the output control terminal of the 10A data latches 78 and their outputs are enabled for the duration of this timing pulse. When not enabled, the outputs of the data latches are in a high impedance state. In this high impedance state, the latch outputs neither load nor drive the signal lines to which they are connected.

The second set of wire fire timers is comprised of a 10B delay timer 92 which is connected and drives a 10B one-shot timer 93. The latter supplies the wire fire timing pulse to the 10B data latches 79 via conductor 83. The third set of wire fire timers is comprised of an 8A delay timer 94 which drives an 8A one-shot timer 95. The one-shot timer 95 produces the wire fire timing pulse which is supplied by way of conductor 85 to the 8A data latches 80. The fourth set of wire fire timers includes an 8B delay timer 96 which drives an 8B one-shot timer 97. Timer 97 produces the wire fire timing pulse which is supplied by way of conductor 86 to the 8B data latches 81.

The output of each of the latch circuits in each of the data latch sets 78–81 produces a high impedance output condition whenever no timing pulse is being supplied to its latch set by the associated one-shot timer. When, on the other hand, a timing pulse is being applied, the logic value (high or low logic level) stored in the latch circuit is supplied to and appears on the signal line connected to the output of the latch circuit.

Each of the timers 90–97 may be implemented by using, for example, Intel 8254 Programmable Interval Timer integrated circuit modules, such modules currently being manufactured by Intel Corporation of Santa Clara, Calif. Each 8254 module contains three independent 16-bit timers. Thus, a total of three 8254 modules are needed to implement the eight timers 90–97. Each 8254 timer includes a 16-bit presettable down counter. Each 8254 timer also includes eight data bit input terminals for enabling a desired plural-bit numerical value to be loaded into its down counter in a parallel manner for purposes of presetting such down counter to a desired count value. Each 8254 timer further includes a clock input terminal, a gate input terminal and a signal output terminal. The clock input terminal is for receiving clock pulses which are counted by the down counter. The gate input terminal is for receiving a control signal for enabling and disabling the counting action in the down counter. The signal output terminal supplies an internally-generated output signal when the count in the down counter reaches a value of zero.

In terms of the FIG. 12 application, the clock pulses for each of timers 90–97 are generated by a high-frequency clock generator circuit 98, such clock pulses being supplied by way of output line 99 to the clock input terminal of each of the timers 90–97. The clock frequency may be, for example, one megahertz, in which case the clock pulses occur at a rate of one pulse per microsecond.

Each of the one-shot timers 91, 93, 95 and 97 is preloaded with a constant value representing the desired duration of each wire fire pulse. A representative value of 270 microseconds will be assumed herein for this wire fire pulse duration. This 270 value is preloaded into each of the one-shot timers by way of its 8-bit data input terminals which are connected to the data bus lines of the printhead microprocessor 67. For simplicity of illustration, these connections to the bus 67 are not shown. This preloading of the one-shot timers is accomplished by the printhead microprocessor 65 as part of the controller initialization procedures which are performed each time the printer is turned on for use. During normal printing operations, an output pulse from the associated delay timer (e.g., 90) is supplied to gate input terminal of the one-shot timer (e.g., 91) and causes the one-shot timer (e.g., 91) to commence counting down the 270 microsecond value. The one-shot timer (e.g., 91) produces a distinctive output signal which exists for the duration of this count down process. Thus, a 270 microsecond output pulse is produced by each one-shot timer each time an input pulse is received from its associated delay timer Each of the delay timers 90, 92, 94 and 96 periodically receives a plural-bit binary time delay value from the printhead microprocessor 65 via bus 67. This time delay value will be different for different printhead speeds, different dot densities, etc. These time delay values are loaded in a parallel manner into the down counters in each delay timer for purposes of presetting each down counter to a desired time delay value. The loading of a new time delay value into a down counter causes the down counter to start a down counting operation therein. When the count value in the down counter reaches a zero value, the delay timer produces an output pulse which is supplied via its output terminal to the input of the associated one-shot timer. The time delay value loaded into the delay timer thus determines the time delay applied to the starting of the wire fire pulse produced by the one-shot timer. This time delay will vary from time to time to reflect changes in printhead speed, dot density and print starting position.

Figure 13:
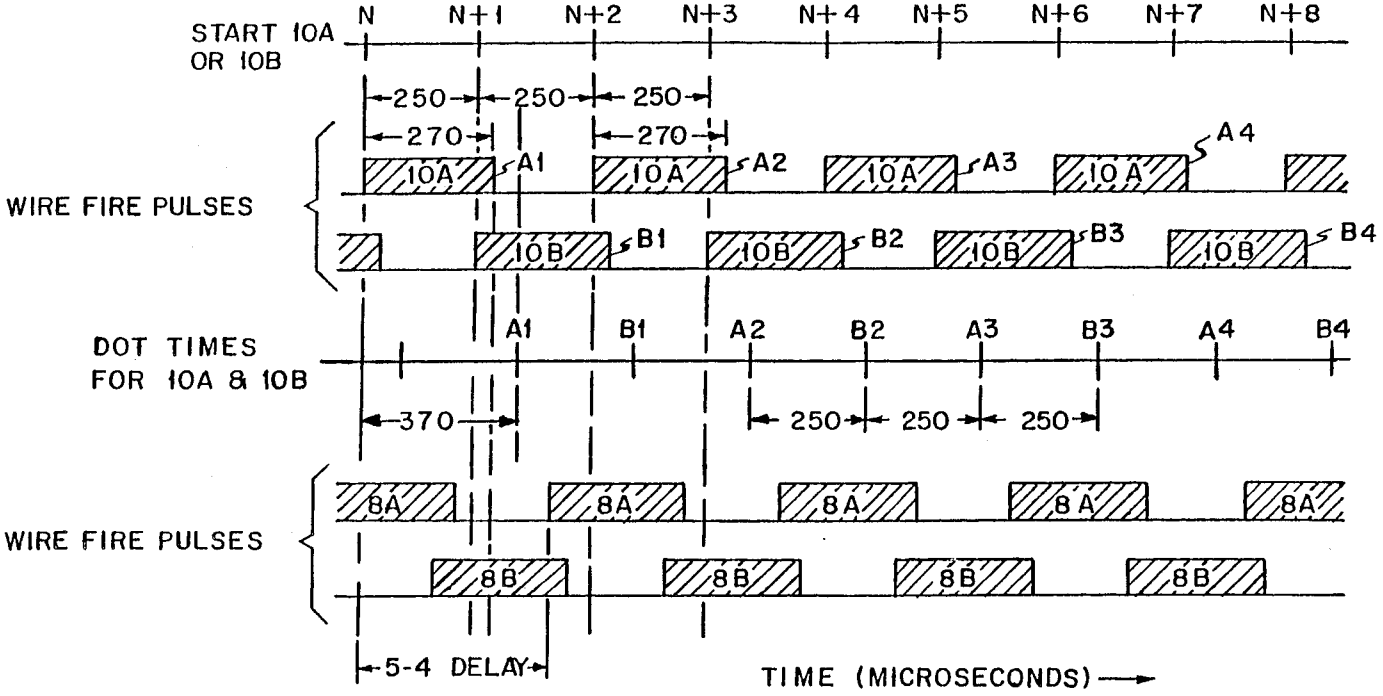
FIG. 13 is a timing diagram used in explaining the operation of the FIG. 12 circuits.

FIG. 13 is a timing diagram for the wire fire pulses produced by the various one-shot timers 91, 93, 95 and 97. During the movement of the printhead across a segment of printing, each of th one-shot timers produces a train of wire fire pulses. Each wire fire pulse in each train is of the same time duration, which time duration is determined by the count value which is preset into the one-shot timers. This count value is chosen to provide the optimum duration driving pulse for the particular print wire actuator construction being used. This wire fire pulse duration should be of sufficient length to bring the print wire armature into firm engagement with the actuator coil pole piece. A representative value for the wire fire pulse duration is 270 microseconds.

The timing diagram of FIG. 13 is for the case of the 18-wire printhead of FIG. 5 when operating in a DP quality mode with a pitch of 10 characters per inch. The distance between successive dot option positions is assumed to be 0.01 inches. The speed of movement of the printhead is assumed to be 40 inches per second. The print wire flight time is assumed to be 370 microseconds. The duration of each wire fire pulse is assumed to be 270 microseconds. For an option distance of 0.01 inches and a speed of 40 inches per second, it takes the printhead a time interval of 250 microseconds to move from one option to the next.

For the printhead of FIG. 5, the reference point for position measuring purposes is defined to be the center point of print wire 1. Thus, by printhead position is meant the center point of print wire 1.

FIG. 13 illustrates the timing problem that is encountered when operating at 40 inches per second with a wire fire pulse duration of 270 microseconds. When operating at this speed, the time difference between successive dot option positions is 250 microseconds. This is less than the duration of the wire fire pulse. Thus, the firing of the print wires for a second option position are required to be commenced before completion of the wire fire pulses for the preceding option position. This problem is solved herein by using two wire fire data latches for each print wire. As a consequence, print wires that were not fired at one option position can be fired at the next succeeding option position. When the print head is moving at a high speed such as 40 inches per second, the same print wire cannot and is not allowed to try to print at two successive option positions. Print wires that were not fired at the first option position can, however, be fired at the second option position, provided separate data latches are provided to receive the dot data for the second option position.

Considering in greater detail the 10A and 10B wire fire pulses, the two pulse trains are identical except that the pulses thereof are shifted in time relative to one another. In particular, the two pulse trains are offset by one-half of a cycle which, in the present case, is equal to 250 microseconds. The 10A pulses are individually identified as A1, A2, A3, etc., while the 10B pulses are individually identified as B1, B2, B3, etc. If a print wire is fired by the A1 pulse, it will produce a dot on the paper at point A1 on the dot time scale. This occurs 370 microseconds after the beginning of the A1 wire fire pulse. If a print wire is fired by the B1 pulse, it will produce a dot at the B1 point on the dot time scale. This occurs 370 microseconds after the leading edge of the B1 pulse. The remaining 10A and 10B pulses are likewise capable of producing dots 370 microseconds after their leading edges. Thus, the 10A and 10B pulses take turns in enabling dots to be printed on the paper. The 10A pulses can, for example, cause dots to be printed at the odd numbered dot options while the 10B pulses can, for example, enable dots to be printed at the even numbered dot options.

At any given option position, none, one, some or all of the print wires in the 10-wire group can be fired. Those not fired at any given dot option position can be fired at the next succeeding option position if desired, even though the wire fire pulse for the first option is not yet completed.

The problem of the time between option positions being shorter than either the wire fire pulse duration or the print wire flight time does not occur for the case of slower printhead movement speeds wherein the time required for the printhead to move from one option position to the next is substantially greater than the print wire flight time.

Considering now the 8A and 8B wire fire timing pulses of FIG. 13, the relationship between these two pulse trains is the same as that between the 10A and 10B pulse trains. More particularly, each 8A and 8B timing pulse has a duration of 270 microseconds. The pulses in the 8B train are offset or shifted by a factor of one-half the time period for the 8A pulses. By time period is meant the time period from the leading edge of one 8A pulse to the leading edge of the next 8A pulse. This time period is 500 microseconds for both the 8A and 8B pulse trains.

The 8A and 8B pulse trains are shifted relative to the 10A and 10B pulse trains in order to take into account the horizontal spacing or separation distance between the group 1 and group 2 wires in each set, this spacing being the same for both sets. In the FIG. 5 embodiment, this five-wire group to four-wire group spacing is one-sixtieth (1/60) of an inch, which is equal to five emitter units. Thus, the leading edge of each 8A pulse is delayed by a factor of five emitters relative to the leading edge of the corresponding 10A pulse and the leading edge of each 8B pulse is delayed by a factor of five emitters relative to the leading edge of the corresponding 10B pulse. This represents the movement required to bring a four-wire group to the same position at which its associated five-wire group was enabled for firing. For the case of FIG. 13, where the distance between successive option positions is 3 emitters and the printhead speed is 40 inches per second, this means that the leading edges of the 8A pulses are delayed by 1.67 options or approximately 417 microseconds relative to the leading edges of the corresponding 10A pulses. The same relationship exists between the 10B and 8B pulses. In the control logic embodiment to be described hereinafter, this five-wire to four-wire delay is handled in a somewhat different manner from that just described. This latter manner is preferred.

One other factor should be noted, namely, the reason why the print wires in the second five-wire group can be fired at the same time as the print wires in the first five-wire group. The reason for this is that the option-to-option spacings which can be printed by the printer were selected relative to the horizontal spacing between the five-wire groups so that the group-to-group spacing is always a whole number multiple of the option-to-option spacing. Thus, when one five-wire group is at a given option position, the second five-wire group is at a different but proper option position. Thus, for example, for the case of 100 options per inch, the option position printed by the second five-wire group is exactly 30 options removed from the option position printed by the first five-wire group. This difference is taken into account by the order in which the dot data is supplied to the wire fire latches. In particular, the dot data supplied to the latch circuits for the second five-wire group is dot data that is to be printed 30 options later than the dot data that is supplied to the latch circuits for the first five-wire group. The image microprocessor 61 knows the particular number of options corresponding to the wire group to wire group spacing and places the dot data in the RAM output buffer so that dot data for the different option positions is transferred to the respective ones of the two five-wire latch groups being loaded at any given moment.

Similar considerations apply to the two four-wire print wire groups. The horizontal spacing between the two four-wire groups is also 0.3 inches. In terms of the option-to-option spacings used, this is always a whole number of options. Hence, print wires in one four-wire group can be fired simultaneously with the firing of print wires in the other four-wire group.

Figure 14:
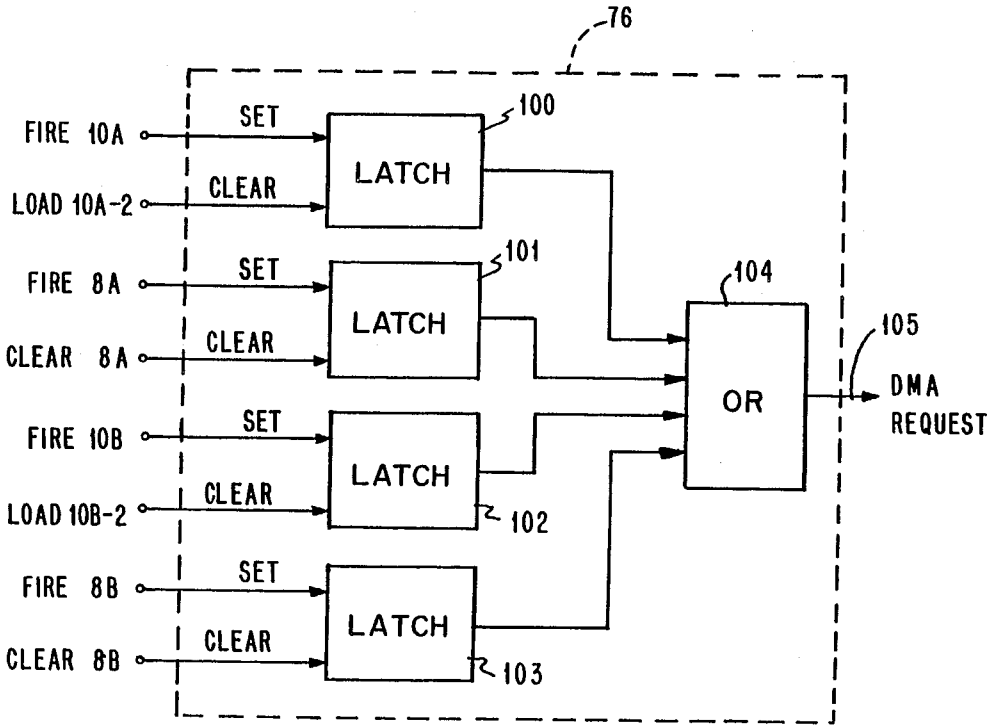
FIG. 14 shows in greater detail the construction of the DMA request circuit of FIG. 10.

Referring to FIG. 14, there is shown in greater detail the construction of the DMA request circuit 76 of FIG. 10. This circuit 76 includes a set of four latches 100–103 which individually provide an indication as to when the corresponding one of data latch sets 78–81 needs new image dot data. Request latches 100–103 are for data latch sets 78–81, respectively.

Each of the request latches 100–103 is placed in a "Clear" state upon completion of the loading of its corresponding data latch set with new data. The Clear state produces a binary zero level at the latch circuit output. As each of the data latch sets 78–81 is activated by a wire fire timing pulse (fire 10A, fire 10B, etc.), its corresponding one of the request latches 100–103 is placed in a "Set" condition. This Set condition produces a binary one level on the latch circuit output line. The outputs of all four of the request latches 100–103 are connected to an OR circuit 104, the output line 105 of which is the request line which runs to the DMA unit 62.

This request line 105 is at a binary one level if any of the latches 100–103 is in a Set condition. A binary one level on request line 105 causes the DMA unit 62 to commence supplying new dot data to the wire fire data latch sets 78–81. This new data is supplied to the different latch sets 78–81 one at a time in a rotating manner so long as the DMA request line 105 remains at a binary one level. As each data latch set receives new data, its corresponding one of request latches 100–103 is returned to the Clear condition. When all of the data latch sets have received new data, all of the request latches 100–103 are in a Clear condition and the DMA request line 105 goes to a binary zero level. This zero level signifies the absence of a DMA request.

The fire pulses which set the request latches 100–103 are respectively obtained from the one-shot timers 91,95,93 and 97 shown in FIG. 12. The load and clear signals which clear the request latches 100–103 are obtained from the decoder 72 of FIG. 12.

With respect to the placing of the request latches 100–103 in their Set conditions, this setting action is accomplished by the trailing edges of the wire fire pulses supplied to their Set input lines. Consequently, new dot data is not supplied to a data latch set before it is finished with the existing dot data. On the other hand, shortly after termination of the wire fire pulse supplied to a particular one of the data latch sets 78–81, that data latch set is reloaded with new image dot data. Thus, the data latch sets 78–81 are continually being reloaded with new dot data as the printhead 24 moves across the paper being printed on.

Figure 15A:
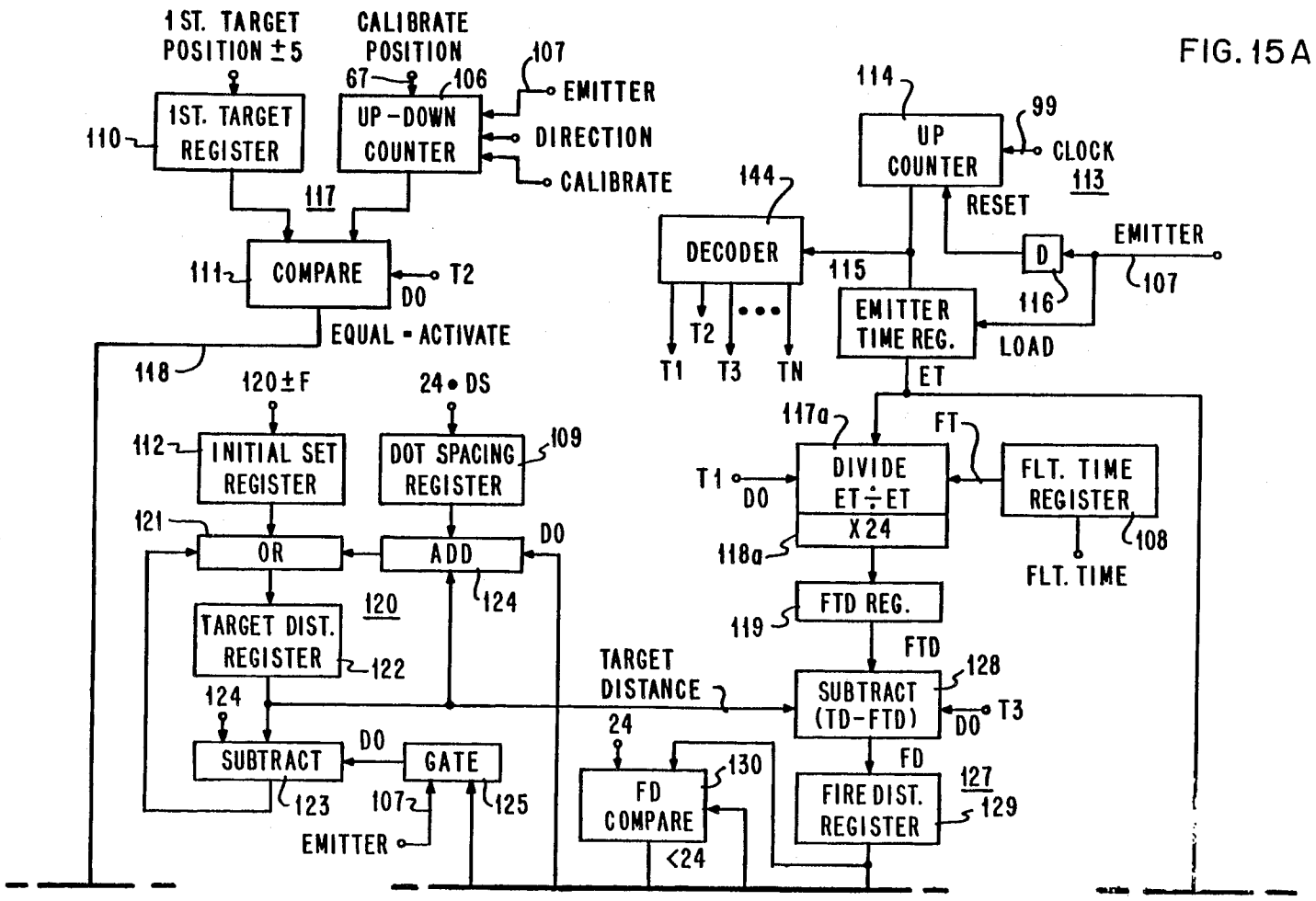
FIG. 15, comprised by FIGS. 15A and 15B, is a schematic block diagram of the logic executed by the printhead microprocessor of FIG. 10 for the wire fire timers shown in FIG. 12.
Figures 15, 15B:
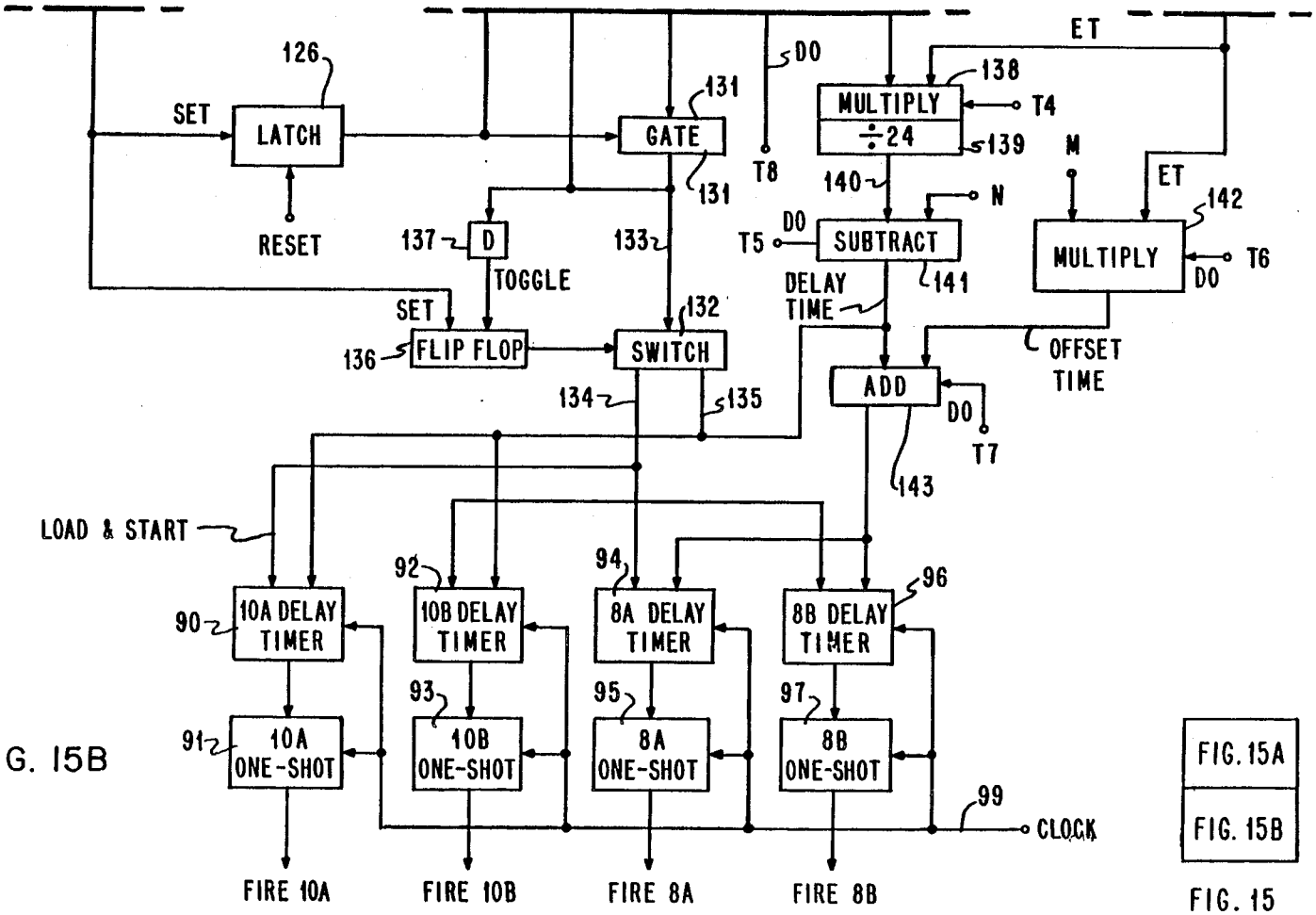

Referring now to FIG. 15, there is shown a schematic block diagram of the logic executed by the printhead microprocessor 65 for the wire fire timers 90–97 shown in FIG. 12. What the printhead microprocessor 65 does is to supply to and to load into each of delay timers 90, 92, 94, 96 a plural-bit delay time signal at the appropriate moment in time such that the delay timer will count off the specified delay time value and at the end of this delay time will trigger its associated one-shot timer to produce its wire fire timing pulse.

The image microprocessor 61 (FIG. 10) sends various operating parameter data to the printhead microprocessor 65. This parameter data is sent in the form of commands via the interface circuits 68. In general, these operating parameter values are loaded into appropriate registers in the printhead microprocessor 65 for subsequent use A first command which is sent to the printhead microprocessor 65 shortly after the printer is turned on is a "Calibrate Head Position" command. This causes calibration of a bidirectional (up-down) multistage binary counter 106 located in the printhead microprocessor 65 and shown in FIG. 15. This command causes the printhead carriage 25 to be moved to the extreme left-hand side of the printer so as to place it against the left-hand side frame 21. With the printhead carriage 25 in this position, a position reference value is loaded into the up-down counter 106 via the printhead processor bus 67, this position reference value being obtained from ROM 66. Thereafter, the up-down counter 106 keeps track of the position of the printhead 24 across the length of the platen 23 by counting the emitter pulses produced by emitter A (FIG. 10) and appearing on line 107. As the printhead 24 moves toward the right, the count in counter 106 is increased one count for each emitter pulse. When the printhead 24 moves toward the left, the count in counter 106 is decreased by one count for each emitter pulse. Thus, the count in counter 106 at any given instant represents the actual position of the printhead 24 at that instant. More precisely, it represents the position of the center point of print wire 1 in the printhead 24. This position value is expressed in terms of emitter units wherein each emitter unit is equal to one three-hundredths (1/300) of an inch. Counter 106 provides a continuous indication of the actual position of the printhead 24 and hence of the print wires contained therein.

Another initial parameter command sent to the microprocessor 65 is a "Set Flight Time" command. The parameter value portion of this command represents the print wire flight time, expressed in microseconds, for the particular printhead and print wire actuator construction being used. Unless otherwise indicated, this flight time value will be assumed to be 370 microseconds. This flight time value is loaded into a flight time register 108 in the printhead microprocessor 65, such register being shown in FIG. 15. Since this flight time value remains substantially constant for any given usage of the printer, its value is normally loaded into the flight time register 108 only once during each usage of the printer.

Another parameter command which is sent to the printhead microprocessor 65 is a "Set Print Speed" command. The parameter value included with this command is the desired speed of movement of the printhead 24 across the paper being printed on. At any given moment, the actual printhead speed may differ from this desired speed. Consequently, the wire fire control mechanism being described herein continuously monitors and makes use of the actual speed, as opposed to the desired speed. A new Set Print Speed command is set to the printhead microprocessor 65 whenever a change in the desired speed is needed. This printhead speed parameter is used in connection with the motor control circuits 69.

Another parameter command sent to the printhead microprocessor 65 by the image microprocessor 61 is a "Set Print Density" command. The data value associated with this command represents the distance between consecutive dot option positions. This dot spacing value or, more accurately, option spacing value is loaded into a dot spacing register 109 contained in the printhead microprocessor 65. This is done before the commencement of any segment of printing having a different dot density than the preceding segment of printing.

The dot spacing (DS) value loaded into the register 109 includes both whole and fractional emitter unit components. This is accomplished by expressing the dot spacing value in terms of emitter subunits, there being 24 subunits per emitter unit in the present embodiment. Thus, dot spacing is not limited to whole number multiples of the emitter distance value. It may, but need not be, a whole number of emitters. For the example shown in FIG. 16, where the dot spacing is 3.0 emitters, the dot spacing value loaded into register 109 is "72", this value being obtained by multiplying 3.0 times 24.

Another parameter command which is sent from the image microprocessor 61 to the printhead microprocessor 65 is a "Print" command. This command is sent prior to each segment of printing on every line of printing. Each print command contains two parameter values, namely, the start target position and the stop target position for the segment of printing in question. The segment of printing specified for a start command may cover anywhere from the entire length of a line of printing to only a small portion of the total length of a print line. This print command is the command which initiates the printing of a segment of material. Receipt of this command by the printhead microprocessor 65 causes the printhead 24 to print from the start target position to the stop target position at the currently active printhead speed value. The printhead microprocessor 65 determines the direction of travel for the printhead 24 by comparing the start position to the stop position and setting a head direction control bit accordingly.

The start target position in the print command is expressed in whole and fractional emitter units. In particular, one data field in the command contains a value representing the whole number of emitter units for the start target position. Another data field contains a value representing the number of 1/24th emitter subunits for the start target position. Thus, the starting point of a segment of printing is not limited to one of the fixed points defined by the positive-going edges of the emitter signals.

The printhead microprocessor 65 calculates a modified version of the whole number start target position value supplied by the print command and loads this modified version into a first target register 110 shown in FIG. 15. This modified start target is five emitter units ahead of the actual whole number start target value. This is done to enable a proper start-up of the control mechanism shown in FIG. 15. For the case where the printhead is moving from left to right across the printed page, a value of five emitter units is subtracted from the whole emitter start position component, and the result is loaded into the first target register 110. This enables an activation signal to be developed by the FIG. 15 control mechanism when the printhead 24 is approximately five emitter units to the left of the first dot position at which printing is to be allowed.

When the printhead 24 is moving in the opposite direction, namely, from right to left, the modified first target position value is obtained by adding a value of five emitter units to the start target position whole number component specified by the print command. This enables the activation signal to be produced approximately five emitter units to the right of the actual first target position for the case of right to left movement. The printhead position values in up-down counter 106 are, of course, decreasing for this right to left movement.

The activation signal is produced by a binary signal comparison mechanism 111 which receives the binary coded position signals from the up-down counter 106 and the first target register 110. During movement of the printhead, the position value in counter 106 is continually changing. When this printhead position value in counter 106 becomes equal to the first target position value in register 110, the comparison mechanism 111 produces the activation signal at its output.

The present embodiment includes a target distance determining mechanism which is activated by the activation signal for thereafter continuously calculating the distance remaining to the next target position. This mechanism makes use of an initial setting value which is loaded into an initial set register 112 after receipt of the print command but before commencement of its execution. This value is expressed in 1/24th emitter subunits. Its numerical value is equal to 120±F. The "120" portion corresponds to five whole emitter units (5×24=120) and enables correlation with the five emitter unit modification of the first target position signal loaded into the first target register 110. The "F" portion is the 1/24th emitter start target fractional value supplied by the print command. This F component, when not equal to zero, causes the starting point for the printing to fall between two of the fixed points defined by the positive-going edges of the emitter signals. If the printhead is moving from left to right, this F value is added to the 120 value and the result is loaded into the initial set register 112. If, on the other hand, the printhead is moving from right to left, the F value is subtracted from the 120 value and the result is loaded into register 112.

The wire fire control mechanism embodiment of FIG. 15 includes a speed sensing mechanism 113 for continuously monitoring or measuring the speed of movement of the printhead 24 as it is moved across the paper being printed upon. This speed sensing mechanism 113 includes an up counter 114, an emitter time (ET) register 115 and a delay element 116. The purpose is to measure the time duration of each emitter signal cycle. This s accomplished by using the up counter 114 to count the number of one microsecond clock pulses which are produced by clock 98 (FIG. 12) during the occurrence of each emitter cycle. To this end, the emitter signals from emitter A are supplied via line 107 and by way of delay element 116 to the reset terminal of the up counter 114. The positive-going edge of each emitter signal is effective to reset the up counter 114. After each resetting, the up counter 114 counts the number of clock pulses until the occurrence of the positive-going edge of the next emitter signal cycle. This next positive-going edge is used to load the emitter time register 115 with the count value then appearing in the up counter 114. The delay element 116 provides a very small time delay and is used to delay the resetting of the up counter 114 until after the loading of its number value into the register 115 has been completed.

The number value loaded into the emitter time register 115 represents the time duration in microseconds of one complete emitter signal cycle. Thus, this number value is called the emitter time (ET). It is a speed dependent signal and is, in fact, inversely proportional to the speed of movement of the printhead. For sake of simplicity, this ET signal may be sometimes referred to herein as a speed signal.

A point to note is that the speed dependent emitter time signal is recalculated for each and every emitter signal cycle. Thus, the control mechanism of FIG. 15 can quickly respond to changes in speed of the printhead movement.

The wire fire control mechanism also includes means for sensing movement of the printhead 24 and providing movement signals representing movement of the printhead across the print receiving paper. This movement sensing means includes the emitter A (FIG. 10) which produces the emitter signals and the signal supply line 107 which supplies these signals to the printhead microprocessor 65. As indicated in FIG. 15, this emitter signal supply line 107 is coupled to the various counter mechanisms in the FIG. 15 control mechanism. The term "emitter" associated with this supply line 107 means the emitter signals produced by emitter A. These emitter signals are printhead movement signals and are sometimes referred to as such herein.

The wire fire control mechanism embodiment of FIG. 15 includes an initial target determining mechanism 117 responsive to the first target position signal and the movement (emitter) signals for producing an activation signal. This mechanism includes the up-down counter 106 and the first target register 110 previously considered. This initial target determining mechanism 117 also includes the comparison mechanism 111 for comparing the whole emitter component of the first target signal in register 110 with the printhead position signal provided by counter 106. This mechanism produces an activation signal on output line 118 of compare mechanism 111 when the printhead position signal becomes equal to the whole number component of the first target signal. The comparison mechanism 111 may include, for example, a subtraction mechanism for producing a signal representing the difference between the first target position signal from register 110 and the printhead position signal from counter 106. It may also includes a zero detection mechanism for detecting when this difference becomes zero and thereupon producing the activation signal. The occurrence of this activation signal signifies that the printhead 24 is approximately five emitter units removed from the first dot option position at which printing will be enabled.

Figure 16:
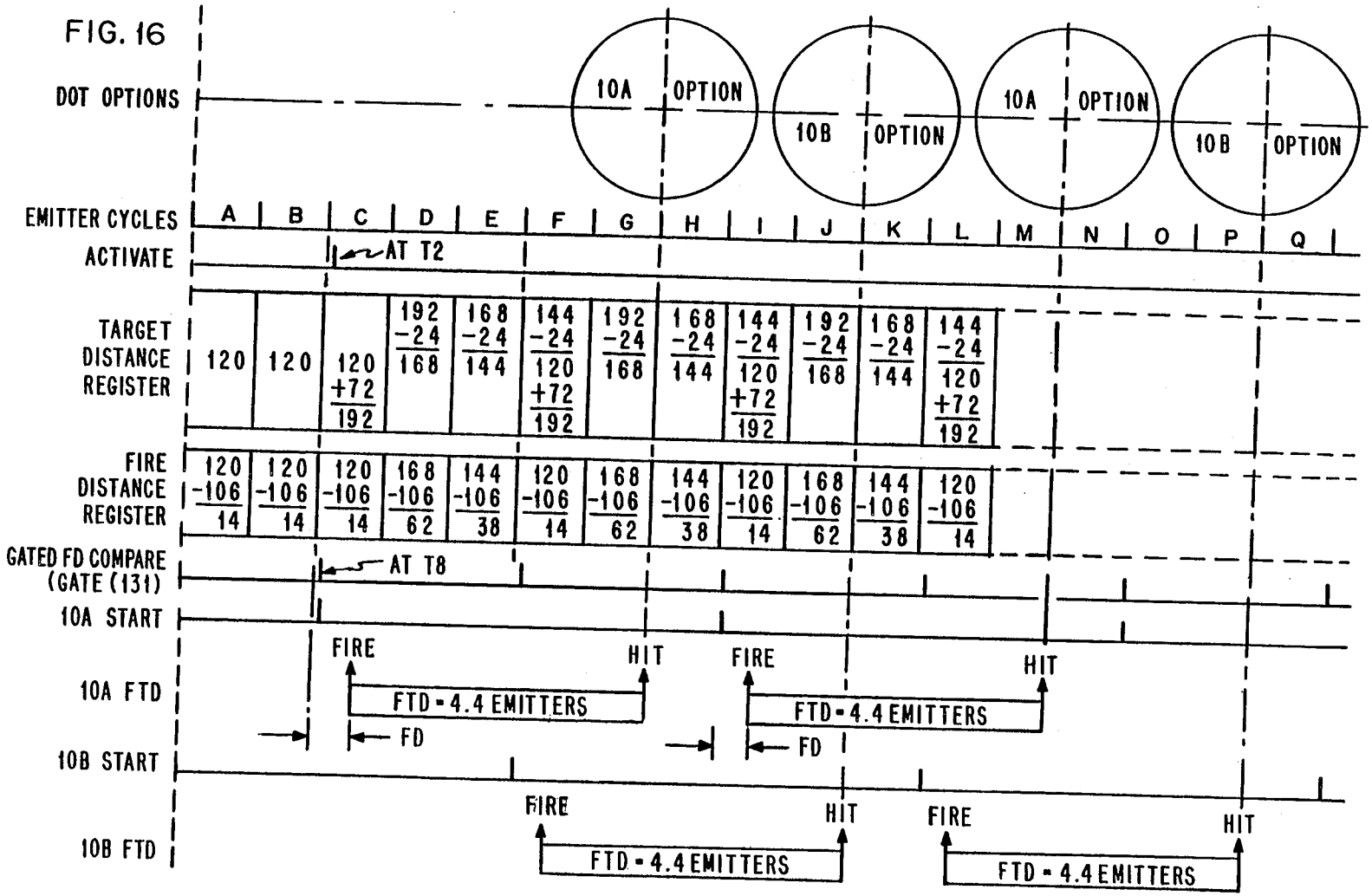
FIG. 16 is a distance diagram used in explaining the operation of the FIG. 15 logic.

For the numerical examples to be given hereinafter, it is assumed that the printer is operating in the DP mode with a pitch of 10 characters per inch. The printhead speed is assumed to be 40 inches per second, the option distance between successive dot options is assumed to be 3.0 emitters and the print wire flight time is assumed to be 370 microseconds. This flight time value gives a flight time distance of 4.4 emitters, which is the value shown in FIG. 16 (the distance between the fire point and the hit point). In this regard, the horizontal scale in FIG. 16 is in terms of distance and not time. In the FIG. 16 example, the activation signal produced by the compare mechanism 111 occurs during emitter cycle C.

The wire fire control mechanism of FIG. 15 further includes a flight time distance (FTD) mechanism which is responsive to the movement (emitter) signals for producing a flight time distance signal representing the distance the printhead will move during the time interval the print wire is in flight from the printhead to the paper. This mechanism includes the speed sensing mechanism 113 previously considered, which mechanism produces the emitter time (ET) signal. It further includes the flight time register 108, a divider mechanism **117*a*, a multiplier mechanism 118*a* and a flight time distance (FTD) register 119. The divider mechanism 117*a* divides the flight time value by the emitter time value to produce the flight time distance (FTD) signal. This FTD signal is expressed in whole and fractional emitter units. In the assumed example, this flight time distance is 4.4 emitters. The multiplier mechanism 118*a* multiplies this FTD value by 24 to convert it to a 1/24th emitter subunit value. In the assumed example, this value is 106 emitter subunits. This value of 106 is placed in the FTD register 119**.

In a preferred embodiment, a separate mechanism is not provided for performing the multiplying by 24 function represented by the multiplier mechanism 118*a*. Instead, the multiplying by 24 is accomplished in the divider mechanism 117*a* by proper scaling of the divider output signal.

The wire fire control mechanism embodiment of FIG. 15 includes a target distance determining mechanism 120 for providing a continuously updated target distance signal representing the distance to the next dot option position to be encountered by the printhead 24. This target distance determining mechanism 120 includes the dot spacing register 109 and the initial set register 112 previously considered. It also includes a multistage OR mechanism 121, a target distance (TD) register 122, a subtraction mechanism 123, an adding mechanism 124, and a signal gating mechanism 125. Initially, the initial set value in register 112 is loaded into the target distance register 122. This is done shortly after receipt of the print command by the printhead microprocessor 65 and well before the activation signal is produced by the compare mechanism 111. For the FIG. 16 example, the F factor representing the fractional part of the start position value in the print command is assumed to be zero. In this case, a value of 120 is initially loaded into the target distance register 22. This value in register 122 remains unchanged until the occurrence of the activation signal. This initial value in target distance register 122 represents the distance from the activation point to the first dot option position. As mentioned, a value of 120 corresponds to five whole emitter units.

The occurrence of an activation signal at the output of compare mechanism 111 serves to place a latch mechanism 126 in a set condition. This set condition causes the latch 126 to supply an enabling signal to the control input of the gate mechanism 125 for enabling it to pass signals from its signal input to its signal output. Previous to the occurrence of this activation signal, the latch 126 was in its reset condition and the gate 125 was disabled. Latch 126 remains in its set condition for the duration of the segment of printing to be performed. It is thereafter returned to its reset condition when the printhead reaches the stop target position or shortly thereafter.

When the gate 125 is enabled, it passes emitter signals appearing on line 107 to the control (Do) input of the subtraction mechanism 123. Each time a new emitter signal appears on the line 107, it causes the subtraction mechanism 123 to subtract a value of 24 from the current target distance value in register 122. In particular, the subtraction mechanism 123 takes the current value in register 122 and subtracts 24 from it and then loads the result back into the register 122 via the OR mechanism 121. In this manner, each emitter pulse occurring while the gate 125 is enabled serves to decrement the target distance value in register 122 by a factor of 24, which factor corresponds to one whole emitter unit. In this manner, the target distance in register 122 is continually updated as the printhead moves along the print line.

This updating or decrementing of the target distance register 122 continues until a load and start pulse is produced for one of the delay timers 90, 92, 94, and 96. When such a load and start pulse occurs, the value in the target distance register 122 is increased by a factor which is equal to the dot spacing value expressed in 1/24th emitter subunits. This is accomplished by the adding mechanism 124 which takes the current target distance value from the register 122, adds the dot spacing value in register 109 to it, and supplies the result back to the target distance register 122 via the OR mechanism 121. In the example of FIG. 16, the value in register 109 is equal to 72 subunits, which corresponds to three whole emitter units. Thus, when a start signal is produced for one dot option, the target distance in register 122 is increased by the dot spacing value to reflect the new target distance for the next dot option.

The FIG. 15 embodiment also includes a fire distance determining mechanism 127 for continually determining the distance remaining to the wire fire point for the next dot option. This mechanism 127 includes a subtraction mechanism 128 for subtracting the flight time distance value from the target distance value to produce at its output the desired fire distance value. This fire distance (FD) value is loaded into a fire distance register 129 which is part of the mechanism 127. This fire distance value in register 129 is expressed in terms of the 1/24th emitter subunits.

The fire distance value in register 129 is supplied to a first input of a fire distance (FD) comparison mechanism 130. A constant value of 24 is supplied to the other input of the FD comparison mechanism 130. The comparison mechanism 130 produces an output pulse during each emitter cycle for which the fire distance value in register 129 is less than 24. This signifies that the current printhead position is less than one emitter away from the wire fire point.

If the activation signal has not yet occurred (latch 126 in reset condition), then the output pulses produced by the FD compare 130 are blocked by a gating mechanism 131 and have no effect on the remainder of the units in FIG. 15. If, on the other hand, the activation signal has occurred (latch 126 in set condition), then gate 131 passes the FD compare pulse to a switch mechanism 132 which, in turn, passes the FD compare pulse to two of the delay timers 90, 92, 94, and 96 for purposes of loading and starting same. Switch 132 provides a single-pole double-throw switching function. In one switch position, it connects its input line 133 to its output line 134 and, in its other switch position, connects its input line 133 to its second output line 135. A flip-flop mechanism 136 causes the switch 132 to switch back and forth between its two output lines so that alternate FD compare pulses are supplied to alternate pairs of the delay timers 90, 92, 94, and 96.

The flip-flop 136 is initially placed in its set condition by the activation signal produced by the position comparing mechanism 111. This set condition causes switch 132 to connect its input line 133 to its output line 134 to enable the first FD compare pulse to be supplied to the load and start inputs of the 10A and 8A delay timers 90 and 94. Thereafter, the flip-flop 136 is toggled back and forth between its set and reset conditions by the FD compare pulses. These FD compare pulses are supplied to the toggle input of flip-flop 136 by way of a delay element 137. The magnitude of the time delay provided by delay element 137 is selected so that the toggling caused by any given FD compare pulse occurs after that FD compare pulse has loaded and started the delay timers to which it is supplied. This enables the next FD compare pulse to be supplied to the opposite set of delay timers. In this manner, the FD compare pulses are alternately supplied to the two different sets of delay timers.

The first, third, fifth, etc., FD compare pulses passed by the gate 131 are supplied to the 10A and 8A delay timers. The second, fourth, sixth, etc., FD compare pulses passed by the gate 131 are supplied to the 10B and 8B delay timers.

When an FD compare pulse is passed by the gate 131, it is also supplied to the execution control terminal (Do) of the adding mechanism 124 in the target distance determining portion 120. Each such pulse causes the adding mechanism 124 to increment the value in the target distance register 122 by the dot spacing value obtained from register 109. In the FIG. 16 example, this dot spacing value is 72.

An FD compare pulse is produced when the printhead is less than one emitter unit away from a wire fire point. It is necessary to use the fire distance value which is present in the fire distance register 129 at the occurrence of this FD compare pulse to cause the generation of the desired wire fire pulse at the wire fire point. This fire distance value is a fractional part of an emitter unit. This fractional distance value is converted to an equivalent time value and this equivalent time value is loaded into, for example, the 10A delay timer 90. Delay timer 90 then counts off this equivalent time delay interval and, at the end of such interval, produces the desired wire fire pulse by triggering the 10A one-shot timer 91. A similar procedure is followed for the 10B delay timer 92. A modified version of this procedure is followed for the 8A and 8B delay timers 94 and 96.

Considering in greater detail the procedure for the 10A and 10B delay timers, the fractional emitter fire distance value in register 129 is multiplied by the emitter time ET in a multiply mechanism 138. This converts the distance value into an equivalent time value. The emitter time ET is expressed in terms of microseconds per emitter. Thus, multiplying this emitter time value by the fractional emitter distance gives the time value represented by the fractional emitter distance. This time value is, however, too large because the numerical value in the fire distance register 129 is in 1/24th emitter subunits. Thus, it is necessary to divide by 24 to obtain the correct equivalent time value. This is accomplished by the divide by 24 mechanism 139. In the preferred embodiment, this divide by 24 action is obtained by proper scaling in the multiply mechanism 138, in which case a separate divide by 24 mechanism is not required. In any event, the signal on output line 140 is the time equivalent, expressed in microseconds, of the fractional emitter fire distance in register 129.

This time equivalent value is modified by a subtraction mechanism 141 to compensate for the time delay caused by the performance of the various mathematical and comparison operations shown in FIG. 15. In other words, the time equivalent value on the line 140 represents the value needed at the leading edge of the emitter pulse for the emitter cycle in which the value is determined. Several microseconds are, however, required to do the calculations to obtain this value and to load it into the appropriate 10A or 10B delay timer. The subtraction mechanism 141 compensates for this by subtracting from the calculated time equivalent value a factor N which represents in microseconds the time required to do the calculations and to load the equivalent time value into the appropriate delay timer. In effect, the calculating and loading time delay is treated as part of the needed fire distance delay and only the remaining part of the fire distance delay is loaded into the 10A or 10B delay timer.

The procedure for the 8A and 8B delay timers 94 and 96 is a modified version of the foregoing procedure. In particular, an offset time value is added to the delay time at the output of subtraction mechanism 141 to help compensate for the fact that the print wires in the four-wire groups are physically offset from the print wires in the five-wire groups, it being remembered that the print wires in the four-wire groups are serviced by the 8A and 8B delay timers. Part of the offset is compensated for by the image microprocessor 61 (FIG. 10) by its selection of the dot data which is supplied to the 8A and 8B wire fire data latches (FIG. 12). The remainder of the offset compensation is provided by a multiply mechanism 142 and an adding mechanism 143. The factor M supplied to the multiply mechanism 142 represents the desired offset in whole and fractional emitter units. This is multiplied by the emitter time ET to convert the offset distance M to an equivalent offset time value expressed in microseconds. This offset time is then added by the adder 143 to the delay time which was used for the 10A and 10B timers to produce the delay time to be used by the 8A and 8B delay timers 94 and 96.

For the example shown in FIG. 16, where there are 100 options per inch, the offset distance M is chosen to have a value of 1.0 emitter units. This provides part of the offset compensation, with the remainder of the offset compensation being provided by the proper selection of the dot data loaded into the 8A and 8B wire fire latches. For some option distances (dot spacings), the distance compensation factor M will have a value of zero. This occurs where the dot spacing is such that the five-wire to four-wire offset is a whole number of dot spacings or options. In this case, all of the compensation is provided by the selection of the proper dot data to be placed in the 8A and 8B wire fire latches. For this M equals zero case, no five-wire to four-wire offset time is added to the previously calculated delay time appearing at the output of subtraction mechanism 141.

The various mathematical operations and comparison operations shown in FIG. 15 are controlled by timing pulses developed by a decoder which decodes the count value in the up counter 114 to produce on separate timing pulse output lines respective ones of a sequence of timing pulses T1, T2, T3, etc. The T1 pulse is produced by a first count in counter 114, the T2 pulse by a second count in counter 114, the T3 pulse by a third count in counter 114, etc. The T1 timing pulse is supplied to the divider mechanism 117*a* to cause a performance of the dividing operation therein. The T2 timing pulse causes the performance of the comparing operation in the compare mechanism 111. In a similar vein, the T3 through T8 timing pulses cause the performance of the functions provided by the respective ones of the subtract mechanism 128, the multiply mechanism 138, the subtract mechanism 141, the multiply mechanism 142, the add mechanism 143, and the FD compare mechanism 130. These timing pulses control the sequence in which the different operations are performed.

For the case where the mathematical and comparison operations are performed by the arithmetic and logic unit of a microprogrammed microprocessor, the use of the T1, T2, T3, etc., timing pulses is not needed. In this case, the sequencing of the different operations is automatically performed by the sequencing of the microcode which controls the microprocessor.

FIG. 16 shows an example of the operation of the FIG. 15 wire fire control mechanism for the DP mode of operation with a character density of 10 characters per inch and a printhead movement speed of 40 inches per second. The dot option spacing is 3.0 emitters and the number of options per inch is 100. The print wire flight time is assumed to be 370 microseconds. The printhead is assumed to be moving from left to right across the paper being printed on.

With respect to the initial set register 112, the fractional start target component F is assumed to have a value of zero for the FIG. 16 example. This is indicated by the fact that the center point for the first dot option coincides with the leading edge of an emitter pulse cycle. Thus, the value loaded into the initial set register 112 is a value of 120 emitter subunits. The value loaded into the dot spacing register 109 is 72 emitter subunits. For the assumed case of a printhead speed of 40 inches per second and a print wire flight time of 370 microseconds, the flight time distance in the FTD register has a value of 106 emitter subunits. This FTD value remains constant so long as the printhead speed remains constant at the 40 inches per second value. The emitter pulses occur at the leading edges or beginnings of the emitter cycles.

Emitter cycles A and B in FIG. 16 occur before the occurrence of the activation signal. For these cycles, the value in the target distance register 122 remains constant at 120, this being the value loaded from the initial set register 112. For these cycles, gates 125 and 131 are disabled. The subtract mechanism 128, however, is active to calculate the fire distance value during the T3 timing pulse interval in each cycle. This produces a fire distance value of 14 emitter subunits in the fire distance register 129.

The activation signal is produced during the T2 timing pulse interval of emitter cycle C by the compare mechanism 111. This sets the latch 126 to enable the gates 125 and 131. This occurs too late to allow passage of the emitter pulse occurring at the beginning of emitter cycle C. Thus, the subtract mechanism 123 does not operate during emitter cycle C. Thus, there is no immediate change in the target distance value in register 122. It remains at 120.

The fire distance value of 14 in the fire distance register 129 does play a role during emitter cycle C. In particular, during the T8 timing pulse interval, the FT compare mechanism 130 sees this value of 14 and produces an FD compare pulse. This FD compare pulse is supplied to the adder 124 to increment the value in target distance register 122 by a factor of 72. This same FD compare pulse is also supplied by way of switch 132 to load and start the 10A delay timer 90 with a delay time value corresponding to the 14 emitter subunit fire distance value less the calculation delay compensation factor deducted by subtractor 141. The 10A delay timer 90 counts down this delay time value and, at the end of such delay time, triggers the 10A one-shot timer 91 to produce the 10A wire fire pulse to commence the movement of any 10A print wires which are to produce dots at the first 10A option position. The flight time distance (FTD) for these print wires is indicated in FIG. 16. It has a value of 4.4 emitters. This flight time distance terminates when the fired print wires strike the paper which, as indicated in FIG. 16, occurs at the first 10A option position.

During emitter Cycle D, the emitter pulse supplied to gate 125 causes subtractor 123 to subtract a count of 24 from the target distance register 122. Thus, the resulting count in register 122 is now 168. The 106 FTD value is subtracted from this 168 value to produce a fire distance value of 62 in the fire distance register 129. This value is not less than 24, hence the FD compare mechanism 130 does not produce an FD compare pulse.

A similar set of events occurs during the subsequent emitter cycle E. The target distance value in register 122 is decreased by a factor of 24 to cause a corresponding decrease by a factor of 24 in the fire distance value in register 129. The result has a value of 38, which is still too big to produce an FD compare pulse.

Emitter cycle F is different. It starts off the same by reducing the value in target distance register 122 by a factor of 24. This causes the value in fire distance register 129 to be likewise reduced by a factor of 24. This results in a fire distance value of 14, which, in turn, causes the FD comparator 130 to produce an FD compare pulse. This FD compare pulse is supplied by way of the switch 132, but this time it goes to the 10B delay timer 92 to load and start the timing action therein. At the termination of this delay time, the 10B one-shot timer 93 is triggered to produce the 10B wire fire pulse. This 10B wire fire pulse commences during emitter cycle F because the fire distance value of 14 emitter subunits is less than one emitter unit after the beginning of emitter cycle F.

The FD compare pulse produced during emitter cycle F is also supplied to the adder 124 to increase the count in target distance register 122 by a factor of 72. This occurs after the subtraction of the count of 24 because the FD compare pulse is produced by the T8 timing pulse which occurs after the emitter pulse which activated the subtractor 123. This emitter pulse, in effect, occurs at a T0 timing pulse time.

The foregoing operations are repetitive in nature and are repeated over and over again until the printhead reaches the stop target position specified in the print command. At that point, the activate latch 126 is reset to provides the inactive condition. The wire fire control mechanism then awaits the arrival of the next print command from the image microprocessor 61. In some cases where a series of print commands are issued for the same line of printing, the execution of the next print command may occur so quickly after completion of the printing for the preceeding print command such that the printhead may not come to a complete standstill during the very brief interval between the executions of the two print commands.

In the preferred embodiment, the various mathematical operations (add, subtract, multiply and divide) and the comparison operations shown in FIG. 15 are performed by the arithmetic and logic unit in the printhead microprocessor 65. The various registers are general purpose registers located in the printhead microprocessor 65. The various counters and timers may be implemented in either hardware or software form, or some combination of the two. The movements of the various signals from one point to another are controlled by the microcode associated with the printhead microprocessor 65, which microcode is resident in the ROM unit 66 shown in FIG. 10.

The present invention automatically and efficiently enables printing to be accomplished over a relatively large range of printhead movement speeds. This enables the highest possible printhead speed to be provided for each of various different dot densities. The present invention also enables printing to be performed when the movement of the printhead is either accelerating or decelerating. It is not required to print only when the printhead is moving at a constant speed. The present invention further enables dots to be printed at positions which are not dependent on or limited to the fixed points defined by the emitter signals. This enables a greater range of different character fonts to be provided. All of the foregoing is accomplished with a relatively high degree of dot placement accuracy.

With respect to the appended claims, it is noted that the term "target signal" is used in a generic sense to include various ones of the position and distance signals referred to herein. With respect to the mechanism of FIG. 15, for example, it may mean the first target position signal supplied to the register 110, the target distance signal appearing in the register 122 or the fire distance signal appearing in the register 129. The particular meaning or meanings which are intended in any particular claim are determined by the context of the claim. Unless otherwise limited by the context of the claim, the term "target signal" should be taken as including all of the different position and distance signals referred to in the foregoing description, with the exception of the printhead position signal.

While there have been described what are at present considered to be preferred embodiments of this invention, it will be obvious to those skilled in the art that various changes and modifications may be made therein without departing from the invention, and it is, therefore, intended to cover all such changes and modifications as fall within the true spirit and scope of the invention.

What is claimed is:

1. In a wire matrix printer having a printhead which moves across a print receiving medium, a wire fire control mechanism for a print wire in the moving printhead, such mechanism comprising:

means for supplying a target signal for determining a position at which a dot may be printed on the print receiving medium;

means for sensing movement of the printhead and providing printhead movement signals representing movement of the printhead;

means for sensing the speed of the printhead and producing a flight time distance signal representing the distance the printhead will move during the time interval between the time the print wire is fired and the time the print wire will strike the print receiving medium;

and means responsive to the target signal, the printhead movement signals and the flight time distance signal for producing a wire fire signal when the distance between the print wire position and the target becomes substantially equal to the flight time distance;

said means for producing a wire fire signal including, compensating means responsive to the target signal and to the flight time distance signal for producing a firing distance signal representing the printhead movement needed to reach a wire fire position;

and means including counter means responsive to the firing distance signal and the printhead movement signals for producing the wire fire signal.

2. In a wire matrix printer having a printhead which moves across a print receiving medium, a wire fire control mechanism for a print wire in the moving printhead, such mechanism comprising:

register means for receiving a dot spacing signal from an image data generating mechanism;

emitter means associated with the printhead for producing emitter signals representing fixed increments of movement of the printhead across the print receiving medium;

circuit means for supplying timing signals;

first counter means responsive to the timing signals and to the emitter signals for producing an emitter time signal representing the time duration of an emitter signal;

flight time means for supplying a flight time signal representing the flight time of the print wire;

signal combining means responsive to the emitter time signal and the flight time signal for producing a flight time distance signal representing the distance the printhead will move during the time interval between the time the print wire is fired and the time the print wire will strike the print receiving medium;

compensating means responsive to the dot spacing signal and to the flight time distance signal for producing a firing distance signal representing the printhead movement needed to reach a wire fire position;

and means including second counter means responsive to the firing distance signal and the emitter signals for producing a wire fire signal when the distance between the print wire position and the target becomes substantially equal to the flight time distance.

3. In a wire matrix printer having a printhead carriage which moves in a horizontal direction across a print receiving medium, the combination comprising:

a printhead mounted on the printhead carriage ad having two sets of print wires which are spaced apart a relatively large horizontal distance, each set having first and second groups of print wires which are spaced apart a relatively small horizontal distance, the ends of the print wires in each group being vertically aligned, the ends in each second group being vertically staggered relative to the ends in their associated first group;

first multistage data latch means for receiving image dot data for the print wires in both first groups and having outputs coupled to driving circuitry for the print wires in both first groups;

first control means for enabling the outputs of the first data latch means for enabling simultaneous firing of selected print wires in both first groups;

second multistage data latch means for receiving image dot data for the print wires in both second groups and having outputs coupled to driving circuitry for the print wires in both second groups;

and second control means for enabling the outputs of the second data latch means for enabling simultaneous firing of selected print wires in both second groups.

4. In a wire matrix printer having a printhead which moves across a print receiving medium a wire fire control mechanism for a print wire in the moving printhead, such mechanism comprising:

emitter means associated with the printhead for producing emitter signals representing fixed increments of movement of the printhead across the print receiving medium, each such increment being referred to as an emitter;

target determining means for supplying a target signal which determines a position at which the print wire should be fired to produce a dot on the print receiving medium, such target signal being comprised of a whole emitter component and a fractional emitter component;

said target determining means including;

target distance means for supplying a target distance signal representing the distance to the next dot position;

flight time distance means responsive to the speed of the printhead for producing a flight time distance signal representing the distance the printhead will move during the time interval between the time the print wire is fired and the time the print wire will strike the print receiving mechanism;

and compensating means responsive to the target distance signal and to the flight time distance signal for producing the target signal having the whole emitter and fractional emitter components, whole emitter means responsive to the whole emitter component of the target signal and to the emitter signals for producing a start signal when movement of the printhead satisfies the whole emitter component of the target signal;

and fractional emitter means activated by the start signal and responsive to the fractional emitter component of the target signal for producing a wire fire signal less than one emitter after the occurrence of the start signal.

5. A wire fire control mechanism in accordance with claim 4 wherein the compensating means comprises substrating means for substracting the flight time distance signal from the target distance signal, the difference between the target signal which is used by the remainder of the mechanism.

6. A wire fire control mechanism in accordance with claim 1 wherein the whole emitter means includes counting means for counting the emitter signals and producing a start signal when the number of emitter signals counted is equal to the whole emitter component of the target signal.

7. A wire fire control mechanism in accordance with claim 1 wherein the converting means comprises multiplying means for multiplying the fractional emitter component by the speed dependent signal to produce the delay time signal.

8. In a wire matrix printer having a printhead which moves across a print receiving medium, a wire fire control mechanism for a print wire in the moving printhead, such mechanism comprising:

means for supplying a first target position signal;

means for supplying a dot spacing signal;

means for supplying movement signals representing movement of the printhead across the print receiving medium;

flight time distance determining means responsive to the movement signals for producing a flight time distance signal representing the distance the printhead will move during the time interval between the time the print wire is fired and the time the print wire will strike the print receiving medium;

initial target determining means responsive to the first target position signal and the movement signals for producing an activation signal;

next target determining means responsive to the dot spacing signal and the movement signals for recurrently producing a target marker signal, this next target determining means being initially started by the activation signal and thereafter restarted by its own target marker signal;

and fire distance determining means responsive to the dot spacing signal, the flight time distance signal and the movement signals for recurrently producing wire fire signals for the print wire, this fire distance determining means being initially started by the activation signal and thereafter restarted by the target marker signal.

9. In a wire matrix printer having a printhead which moves across a print receiving medium, a wire fire control mechanism for a print wire in the moving printhead, such mechanism, comprising:

means for supplying a target signal for determining, a position at which a dot may be printed on the print receiving medium;

means for sensing movement of the printhead and providing printhead movement signals representing movement of the printhead;

means for sensing the speed of the printhead and producing a flight time distance signal representing the distance the printhead will move during the time interval between the time the print wire is fired and the time the print wire will strike the print receiving medium;

said means for producing a flight time distance signal including emitter means associated with the printhead for producing emitter signals representing fixed increments of movement of the printhead across the print receiving medium;

circuit means for supplying timing signals;

counter means responsive to the timing signals and to the emitter signals for producing an emitter time signal representing the time duration of an emitter signal;

flight time means for supplying a flight time signal representing the flight time of the print wire;

and signal combining means responsive to the emitter time signal and the flight time signal for producing the flight time distance signal;

said signal combining means comprises dividing means for dividing the flight time signal by the emitter time signal to produce the flight time distance signal;

and means responsive to the target signal, the printhead movement signals and the flight time distance signal for producing a wire fire signal when the distance between the print wire position and the target becomes substantially equal to the flight time distance.

10. In a wire matrix printer having a printhead which moves across a print receiving medium, a wire fire control mechanism for a print wire in the moving printhead, such mechanism comprising:

emitter means associated with the printhead for producing emitter signals representing fixed increments of movement of the printhead across the print receiving medium, each such increment being referred to as an emitter;

target determining means for supplying a target signal which determines a position at which the print wire should be fired to produce a dot on the print receiving medium, such target signal being comprised of a whole emitter component and a fractional emitter component;

whole emitter means responsive to the whole emitter component of the target signal and to the emitter signals for producing a start signal when movement of the printhead satisfies the whole emitter component of the target signal, and fractional emitter means activated by the start signal and responsive to the fractional emitter component of the target signal for producing a wire fire signal less than one emitter after the occurrence of the start signal, said mechanism further including a speed sensing means for sensing the speed of the printhead and producing a speed dependent signal having a value which is different for difference printhead speeds;

the fractional emitter means including converting means responsive to the fractional emitter component of the target signal and to the speed dependent signal for converting the fractional emitter component into a corresponding delay time signal;

and the fractional emitter means further including timing means activated by the start signal and responsive to the delay time signal for producing a wire fire signals at the end of the delay time.

* * * * *